US008154499B2

(12) United States Patent
Iisaka et al.

(10) Patent No.: US 8,154,499 B2
(45) Date of Patent: Apr. 10, 2012

(54) ELECTRO-OPTICAL DEVICE, METHOD FOR DRIVING THE SAME, AND ELECTRONIC APPARATUS

(75) Inventors: Hidehito Iisaka, Shiojiri (JP); Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 956 days.

(21) Appl. No.: 11/750,013

(22) Filed: May 17, 2007

(65) Prior Publication Data

US 2008/0055197 A1 Mar. 6, 2008

(30) Foreign Application Priority Data

May 19, 2006 (JP) ..... 2006-140017

(51) Int. Cl.
*G09G 3/36* (2006.01)

(52) U.S. Cl. ..... 345/100; 345/103

(58) Field of Classification Search ..... 345/98–100, 345/103; 377/64–81
See application file for complete search history.

(56) References Cited

U.S. PATENT DOCUMENTS

| | | | | |
|---|---|---|---|---|
| 6,219,022 | B1 * | 4/2001 | Yamazaki et al. | 345/103 |
| 2002/0084959 | A1 * | 7/2002 | Park et al. | 345/87 |
| 2004/0239610 | A1 * | 12/2004 | Ishii | 345/100 |
| 2005/0206601 | A1 | 9/2005 | Aoki | |
| 2006/0012555 | A1 * | 1/2006 | Tokumura | 345/98 |
| 2006/0022931 | A1 * | 2/2006 | Yoshimoto | 345/98 |

FOREIGN PATENT DOCUMENTS

| | | |
|---|---|---|
| JP | A-2000-29433 | 1/2000 |
| JP | A-2002-169520 | 6/2002 |
| JP | A-2003-91270 | 3/2003 |
| JP | A 2004-177930 | 6/2004 |
| JP | A-2005-345878 | 12/2005 |
| JP | A-2006-30529 | 2/2006 |
| JP | A-2006-65291 | 3/2006 |

* cited by examiner

*Primary Examiner* — Amr Awad
*Assistant Examiner* — Kenneth Bukowski
(74) *Attorney, Agent, or Firm* — Oliff & Berridge, PLC

(57) ABSTRACT

An electro-optical device includes a plurality of scanning lines, a plurality of data lines, a plurality of pixels, a scanning-line driving circuit, a block selecting circuit, a sampling circuit, and a control circuit. The scanning-line driving circuit selects the plurality of scanning lines in a predetermined order in each of a first and second field to which a frame is divided and applies a selection voltage. The block selecting circuit selects the blocks in either a right or left direction in a period during which the scanning line is selected. The sampling circuit samples a data signal corresponding to a gray scale level into each of the columns of data lines belonging to a block selected by the block selecting circuit. The control circuit controls the block selecting circuit to, select the blocks in one of the right direction and the left direction for each field.

10 Claims, 18 Drawing Sheets

FIG. 6

| | | | | |
|---|---|---|---|---|
| FIRST FIELD | 433rd ROW | RIGHT DIRECTION | NEGATIVE WRITING | PATTERN A |
| | 1st ROW | LEFT DIRECTION | POSITIVE WRITING | |
| | 434th ROW | LEFT DIRECTION | NEGATIVE WRITING | PATTERN B |
| | 2nd ROW | RIGHT DIRECTION | POSITIVE WRITING | |
| | 435th ROW | RIGHT DIRECTION | NEGATIVE WRITING | PATTERN A |
| | 3rd ROW | LEFT DIRECTION | POSITIVE WRITING | |
| | ⋮ | | | |
| | 864th ROW | LEFT DIRECTION | NEGATIVE WRITING | PATTERN B |
| | 432nd ROW | RIGHT DIRECTION | POSITIVE WRITING | |
| SECOND FIELD | 1st ROW | RIGHT DIRECTION | NEGATIVE WRITING | PATTERN C |
| | 433rd ROW | LEFT DIRECTION | POSITIVE WRITING | |
| | 2nd ROW | LEFT DIRECTION | NEGATIVE WRITING | PATTERN D |
| | 434th ROW | RIGHT DIRECTION | POSITIVE WRITING | |
| | 3rd ROW | RIGHT DIRECTION | NEGATIVE WRITING | PATTERN C |
| | 435th ROW | LEFT DIRECTION | POSITIVE WRITING | |
| | ⋮ | | | |
| | 432nd ROW | LEFT DIRECTION | NEGATIVE WRITING | PATTERN D |
| | 864th ROW | RIGHT DIRECTION | POSITIVE WRITING | |

<HORIZONTAL SCAN: FIRST FIELD (PATTERN A)>

<HORIZONTAL SCAN: SECOND FIELD (PATTERN C)>

<HORIZONTAL SCAN: SECOND FIELD (PATTERN D)>

FIRST FIELD

SECOND FIELD

FIG. 16

| | | | |
|---|---|---|---|
| FIRST FIELD | 1st ROW | RIGHT DIRECTION | POSITIVE WRITING |
| | 2nd ROW | LEFT DIRECTION | POSITIVE WRITING |
| | 3rd ROW | RIGHT DIRECTION | POSITIVE WRITING |
| | 4th ROW | LEFT DIRECTION | POSITIVE WRITING |
| | 5th ROW | RIGHT DIRECTION | POSITIVE WRITING |
| | 6th ROW | LEFT DIRECTION | POSITIVE WRITING |
| | ... | | |
| | 863rd ROW | RIGHT DIRECTION | POSITIVE WRITING |
| | 864th ROW | LEFT DIRECTION | POSITIVE WRITING |
| SECOND FIELD | 1st ROW | LEFT DIRECTION | NEGATIVE WRITING |
| | 2nd ROW | RIGHT DIRECTION | NEGATIVE WRITING |
| | 3rd ROW | LEFT DIRECTION | NEGATIVE WRITING |
| | 4th ROW | RIGHT DIRECTION | NEGATIVE WRITING |
| | 5th ROW | LEFT DIRECTION | NEGATIVE WRITING |
| | 6th ROW | RIGHT DIRECTION | NEGATIVE WRITING |
| | ... | | |
| | 863rd ROW | LEFT DIRECTION | NEGATIVE WRITING |
| | 864th ROW | RIGHT DIRECTION | NEGATIVE WRITING |

ELECTRO-OPTICAL DEVICE, METHOD FOR DRIVING THE SAME, AND ELECTRONIC APPARATUS

BACKGROUND

The present invention relates to a technique for reducing degradation in display quality occurring when a data signal is sampled.

Active-matrix electro-optical devices that scan pixels by so-called point-at-a-time scanning tend to suffer from display unevenness because periods for which pixels are charged and wiring resistances are different in a horizontal direction on a screen. To address this problem, a technique for switching a horizontal scan direction between forward and reverse directions at predetermined periods is disclosed in JP-A-2000-029433.

Unfortunately, for such a point-at-a-time scanning method, alternately switching the horizontal scan direction between forward and reverse directions for, for example, each horizontal scan period causes lines that have different light intensities in a horizontal direction to appear every other line. This leads to a tendency that horizontal strips are displayed. Additionally, a problem is revealed in which the point-at-a-time scanning method cannot successfully support displaying images with high definition.

SUMMARY

An advantage of some aspects of the invention is that it provides an electro-optical device capable of reducing display unevenness and of displaying high-definition images, a method for driving the electro-optical device, and an electronic apparatus.

An electro-optical device according to a first aspect of the invention includes a plurality of scanning lines arranged in rows, a plurality of data lines arranged in columns and grouped in blocks for every m columns (m being an integer more than one), a plurality of pixels, a scanning-line driving circuit, a block selecting circuit, a sampling circuit, and a control circuit. Each pixel is made to have a gray scale level in accordance with a data signal sampled into a corresponding data line of the plurality of data lines when a predetermined selection voltage is applied to a corresponding scanning line of the plurality of scanning lines. The scanning-line driving circuit selects the plurality of scanning lines one by one in a predetermined order in each of a first field and a second field to which a frame is divided and applies the selection voltage to the selected scanning line. The block selecting circuit selects the blocks one by one in either a right direction or a left direction in a period during which the scanning line is selected by the scanning-line driving circuit. The sampling circuit samples a data signal corresponding to a gray scale level into each of the m columns of data lines belonging to a block selected by the block selecting circuit. The control circuit controls the block selecting circuit to, when one scanning line is selected in the first field, select the blocks one by one in one of the right direction and the left direction and, when the same scanning line is selected in the second field, select the blocks one by one in the other of the right direction and the left direction.

In accordance with this aspect of the invention, in a horizontal scan period for which the same scanning line is selected, if the blocks are selected one by one, for example, rightward in the first field, the blocks are selected one by one leftward. Therefore, in terms of one frame period, unevenness occurring in the case of rightward selection and unevenness occurring in the case of leftward selection are leveled in each row. This can suppress the occurrence of horizontal stripes. Additionally, since the m data lines are selected in selection of one block, the time for sampling into the data lines can be increased to m times, compared with the point-at-a-time scanning method. Therefore, high-definition display can be realized. Moreover, display unevenness resulting from selection of the m data lines in selection of one block is leveled in the first field and second field.

In the invention, "left direction", "leftward", "right direction", and "rightward" indicated as the direction of selecting blocks are merely used for the sake of convenience to distinguish a first end and a second end of a scanning line.

In the electro-optical device, the scanning-line driving circuit may select the plurality of scanning lines one by one while skipping a predetermined number of rows of scanning lines. The control circuit may control the block selecting circuit to select the blocks one by one in opposite directions between adjacent scanning lines of the plurality of scanning lines.

In the electro-optical device, a display area in which the plurality of pixels are arranged may be divided to at least a first region and a second region in the direction in which the scanning lines are arranged. The scanning-line driving circuit alternately may select scanning lines belonging to the first region and scanning lines belonging to the second region one by one in each of the first field and the second field such that the scanning lines are selected one by one in each of the first region and the second region upwardly or downwardly. In the first field, when a scanning line belonging to the first region is selected, the data signal may have a voltage being one of higher and lower than a predetermined reference voltage and, when a scanning line belonging to the second region is selected, the data signal may have a voltage being the other of higher and lower than the reference voltage. In the second field, when a scanning line in the first region is selected, the data signal may have a voltage being the other of higher and lower than the reference voltage and, when a scanning line in the second region is selected, the data signal may have a voltage being the one of higher and lower than the reference voltage.

At this time, the block selecting circuit may repeat an operation of selecting the blocks one by one in the right direction when a first scanning line of the plurality of scanning lines is selected, in the left direction when a second scanning line following the first scanning line is selected, in the left direction when a third scanning line following the second scanning line is selected, and in the right direction when a fourth scanning line following the third scanning line is selected.

In the invention, "upwardly", "from top", and "downwardly" indicated as the direction of selecting scanning lines are merely used for the sake of convenience to distinguish a first end and a second end of a data line.

In the electro-optical device, the scanning-line driving circuit may select the plurality of scanning lines one by one upwardly or downwardly in each of the first field and the second field. In the first field, the data signal may have a voltage being one of higher and lower than a predetermined reference voltage. In the second field, the data signal may have a voltage being the other of higher and lower than the reference voltage.

At this time, the block selecting circuit may repeat an operation of selecting the blocks one by one in the right direction when a first scanning line is selected and in the left direction when a second scanning line following the first scanning line is selected.

The invention can be conceptualized as a method for driving an electro-optical device, in addition to an electro-optical device, and further as an electronic apparatus that includes the electro-optical device.

BRIEF DESCRIPTION OF THE DRAWINGS

The invention will be described with reference to the accompanying drawings, wherein like numbers reference like elements.

FIG. 6 illustrates a transfer direction and a writing polarity for each horizontal scan period according to the electro-optical device.

FIG. 16 illustrates a transfer direction and a writing polarity for each horizontal scan period according to the electro-optical device.

DETAILED DESCRIPTION OF EMBODIMENTS

Embodiments of the invention will be described below with reference to the accompanying drawings.

First Embodiment

Figure 1:
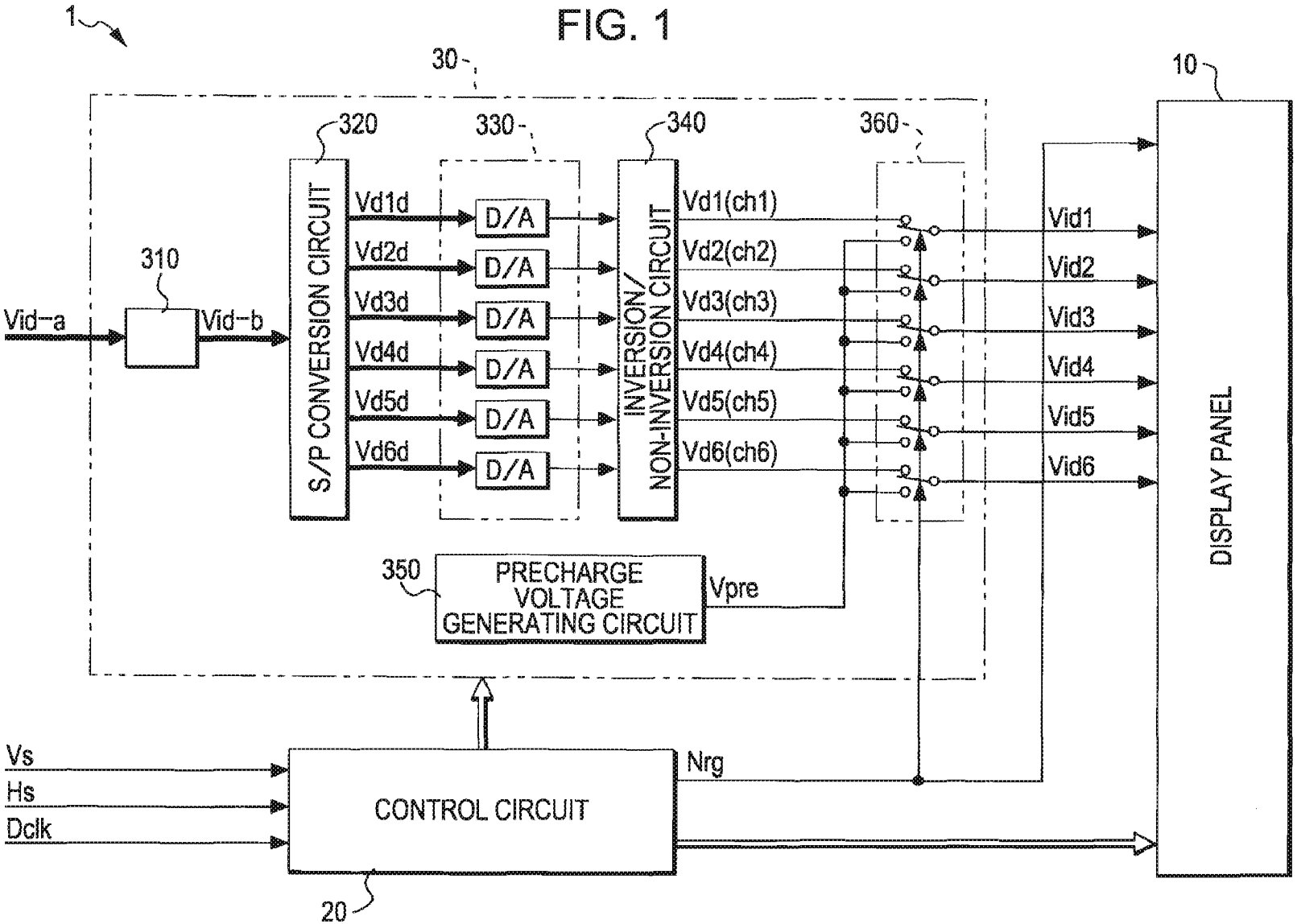
FIG. 1 illustrates a general structure of an electro-optical device according to a first embodiment of the invention.

First, a first embodiment of the invention will be described. FIG. 1 is a block diagram illustrating a general structure of an electro-optical device according to the first embodiment. As illustrated in this drawing, an electro-optical device 1 includes three main components, i.e., a display panel 10, a control circuit 20, and a processing circuit 30. Each of the control circuit 20 and the processing circuit 30 is a circuit module separate from the display panel 10 and is connected to the display panel 10 via, for example, a flexible printed circuit (FPC).

The control circuit 20 controls each unit in response to a vertical synchronous signal Vs, a horizontal synchronous signal Hs, and a dot clock signal Dclk supplied from an external host circuit (not shown).

The processing circuit 30 includes a storage circuit 310, a serial-to-parallel (S/P) conversion circuit 320, a digital-to-analog (D/A) conversion circuit group 330, an inversion/non-inversion circuit 340, a precharge-voltage generating circuit 350, and a selector 360.

The storage circuit 310 temporarily stores display data Vid-a supplied in synchronism with the vertical synchronous signal Vs, the horizontal synchronous signal Hs, and the dot clock signal Dclk, in accordance with an instruction from the control circuit 20. Then, the storage circuit 310 reads the display data Vid-a in accordance with the instruction and outputs it as display data Vid-b. The display data Vid-a (Vid-b) is digital data that specifies a gray scale level (light intensity) of a pixel.

The S/P conversion circuit 320 expands the display data Vid-b read from the storage circuit 310 by six times (phase expansion, also called serial-to-parallel conversion) with respect to the time base in accordance with an instruction from the control circuit 20. In accordance with the instruction, the S/P conversion circuit 320 distributes the expanded data segments to channels ch1 to ch6 to output as display data segments Vd1*d* to Vd6*d* therethrough.

The D/A conversion circuit group 330 is a collection of D/A converters each provided for a channel and converts the display data segments Vd1*d* to Vd6*d* into analog voltages corresponding to gray-scale values. In the present embodiment, after the display data Vid-b is subjected to phase expansion, the data is converted into analog form. However, it should, of course, be understood that the phase expansion may be performed after the data is converted into analog form.

When a positive polarity is specified by the control circuit 20, the inversion/non-inversion circuit 340 converts a voltage of each of the D/A converted analog signals in the six channels into a higher voltage relative to a reference voltage Vc (non-inversion). When a negative polarity is specified by the control circuit 20, the inversion/non-inversion circuit 340 converts the voltage of each of the D/A converted analog signals in the six channels into a lower voltage relative to the reference voltage Vc (inversion). The inversion/non-inversion circuit 340 outputs the converted signals as analog signals Vd1 to Vd6.

The reason why the inversion/non-inversion circuit 340 non-inverts or inverts the polarity of a data signal is to ac-drive pixels. The reference voltage Vc is a potential that corresponds to a center of the amplitude of a data signal, functions as a standard for the polarity for writing into a pixel, and is a voltage that is a substantially intermediate voltage of a power supply voltage (Vdd-Gnd) (see FIG. 9, which will be described below). In other words, in the present embodiment, for a data signal, a side higher than the reference voltage Vc is defined as positive, and a side lower than the reference voltage Vc is defined as negative. For a voltage, a ground potential Gnd of a power supply is a standard unless otherwise described.

The precharge-voltage generating circuit 350 generates a precharge signal Vpre for precharging a data line such that the precharge signal Vpre has a voltage corresponding to the writing polarity. The selector 360 is a collection of double-throw switches provided for the channels ch1 to ch6, respectively. When a signal Nrg is at L level, the selector 360 selects an analog signal converted by the S/P conversion circuit 320; when the signal Nrg is at H level, the selector 360 selects a precharge signal Vpre generated by the precharge-voltage generating circuit 350. The selector 360 supplies the selected signals to the display panel 10 as data signals Vid1 to Vid6. The signal Nrg is supplied from the control circuit 20 in accordance with scan control for the display panel 10. When the logic level of the signal Nrg is H level, a precharge for the data line is specified.

In the present embodiment, each pixel in a display area 100 is driven in each of two fields to which one frame is divided. Here, one frame indicates a time period required for displaying one (one-frame) image, and typically, is approximately 16.7 milliseconds (for a 60-Hz vertical synchronous signal Vs, the reciprocal thereof). To distinguish between two fields in one frame, the former in time is referred to as "first field", and the latter in time is referred to as "second field".

Figure 2:
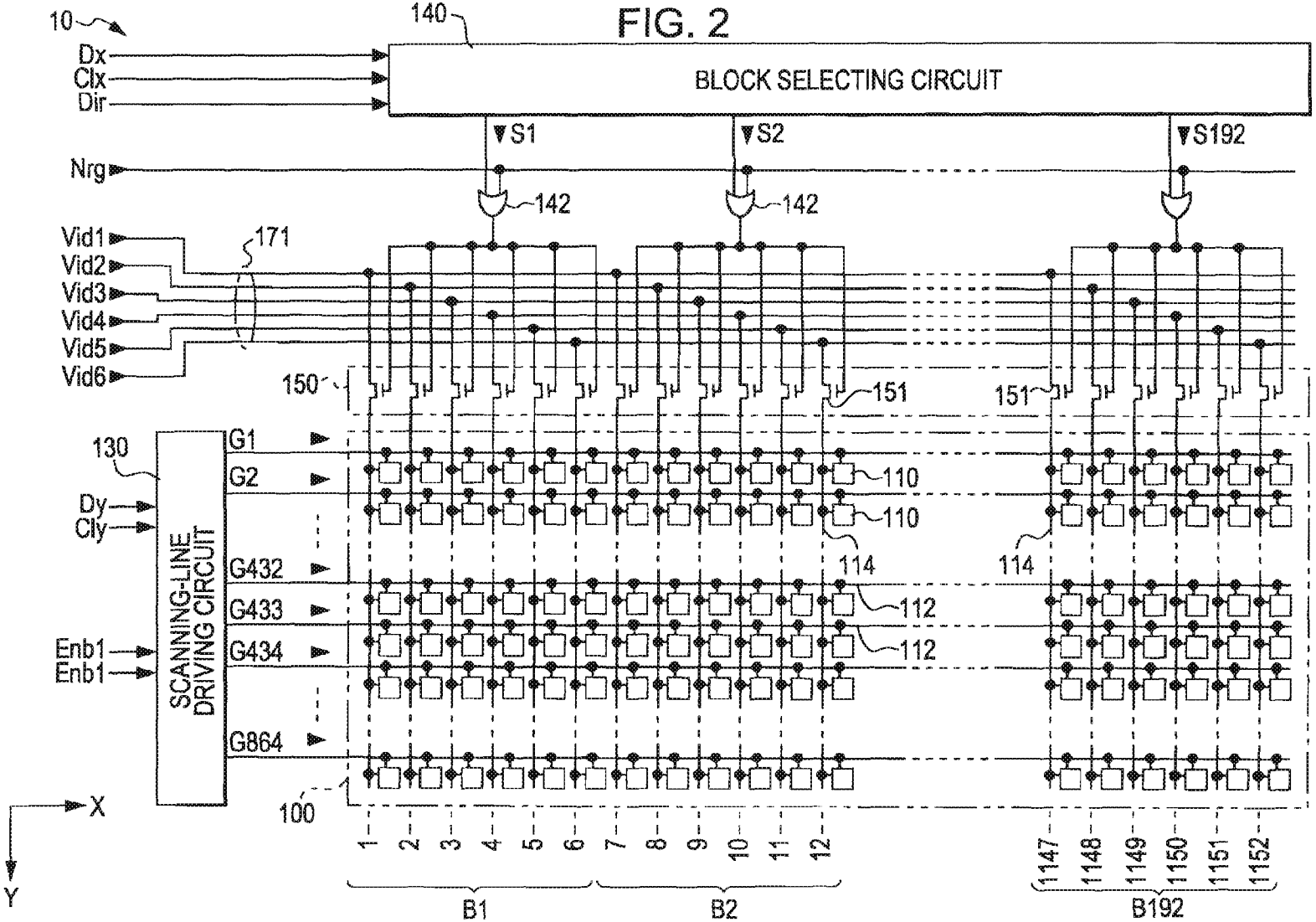
FIG. 2 illustrates a structure of a display panel in the electro-optical device.

Next, a structure of the display panel 10 will be described below. FIG. 2 is a block diagram of the display panel 10.

As illustrated in this drawing, in the display area 100 of the display panel 10, 864 rows of scanning lines 112 extend in the X (horizontal) direction in the drawing and 1152 columns of data lines 114 extend in the Y (vertical) direction in the drawing. Pixels 110 are each provided for the intersection of each of the data lines 114 and each of the scanning lines 112. In the present embodiment, the pixels 110 are arranged in a matrix of 864 rows (vertical) and 1152 columns (horizontal).

In the present embodiment, the display area 100 is divided to two regions, i.e., an upper region (first region) from 1st to 432nd rows and a lower region (second region) from 433rd to 864th rows. In the present embodiment, the 1152 data lines 114 are grouped in blocks for every six columns in order from left in FIG. 2. For the sake of illustration, 1st, 2nd, 3rd, . . . , and 192nd blocks are denoted as B1, B2, B3, . . . and B192, respectively.

Figure 3:
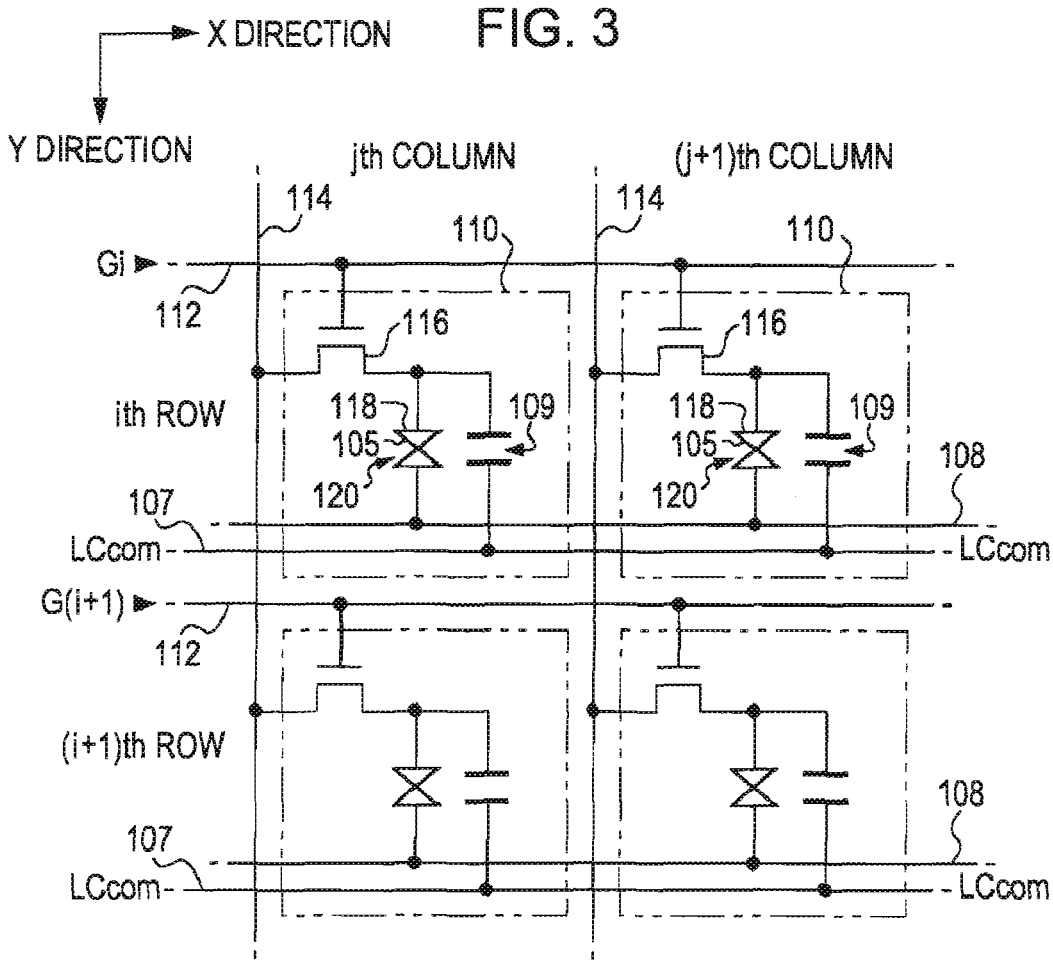
FIG. 3 illustrates a structure of pixels in the display panel.

FIG. 3 illustrates a detailed structure of the pixels 110 in the display panel 10 and shows the structure of a 2 by 2 matrix of four pixels corresponding to intersections of ith and (i+1)th rows and jth and (j+1)th columns. Here, each of i and (i+1) is a symbol for generally representing a row in which the pixels 110 are aligned and is an integer between or equal to 1 and 864. Each of j and (j+1) is a symbol for generally representing a column in which the pixels 110 are aligned and is an integer between or equal to 1 and 1152. For i, as will be described below, it is necessary that i be limited to between or equal to 1 and 432, which belong to the upper region.

As illustrated in FIG. 3, each of the pixels 110 includes an n-channel thin film transistor (hereinafter, abbreviated as "TFT") 116 and a liquid crystal capacitor 120.

The pixels 110 have the same structure, so a pixel 110 corresponding to the intersection of an ith row and a jth column is described as a representative. The TFT 116 of the pixel 110 corresponding to the intersection of the ith row and the jth column has a gate (electrode) connected to the ith scanning line 112, a source (electrode) connected to the jth data line 114, and a drain (electrode) connected to a pixel electrode 118 being a first end of the liquid crystal capacitor 120. A second end of the liquid crystal capacitor 120 is a common electrode 108. The common electrode 108 is common to all pixels. The common electrode 108 is maintained at a voltage LCcom.

Although not illustrated in particular, the display panel 10 has a structure in which an element substrate that includes the scanning lines 112, the data lines 114, the TFTs 116, and the pixel electrodes 118 and an opposing substrate that includes the common electrode 108 are laminated together with a constant gap filled with liquid crystal molecules therebetween such that a surface having the electrodes of the element substrate faces a surface having the electrode of the opposing substrate. Therefore, in the present embodiment, the liquid crystal capacitor 120 is constructed such that a liquid crystal layer 105 is held between the pixel electrodes 118 and the common electrode 108.

In the present embodiment, for the sake of illustration, the normally white mode is set. The normally white mode is a mode in which, if the rms value of voltage maintained by the liquid crystal capacitor 120 is near zero, the transmittance of light passing through the liquid crystal capacitor is maximum, resulting in white display, and, if the amount of transmitted light, which decreases with an increase in the rms value of voltage, is minimum, black display is present.

For the pixel 110 having the above-described structure, applying a selection voltage to the scanning line 112 to switch the TFT 116 on (bring it into conduction) and applying a voltage corresponding a gray scale level (light intensity) to the pixel electrode 118 via the data line 114 and the TFT 116 being in the on state enables the liquid crystal capacitor 120 to hold the voltage corresponding to the gray scale level.

When the scanning line 112 has a non-selection voltage, the TFT 116 is in the off state (nonconducting). Since a resistance at this time (an off resistance) is not an ideal infinite, not some few charges leak from the liquid crystal capacitor 120. To reduce the effects of the off leak, a storage capacitor 109 is provided for each pixel. A first end of the storage capacitor 109 is connected to the pixel electrode 118 (the drain of the TFT 116). A second end of the storage capacitor 109 is connected to a capacitor line 107 common to all pixels. The capacitor line 107 is maintained at a potential that is constant in time, for example, the application voltage LCcom of the common electrode 108.

Referring back to FIG. 2, around the display area 100, peripheral circuits, such as a scanning-line driving circuit 130, a block selecting circuit 140, and a sampling circuit 150, are disposed.

The scanning-line driving circuit 130 selects the 864 scanning lines 112 in one frame one by one in an order described below in accordance with control by the control circuit 20 and supplies scan signals G1, G2, G3, . . . , and G864, which correspond to the selection, to the 1st, 2nd, 3rd, . . . , and 864th scanning lines 112, respectively. That is, in the first field, the scanning-line driving circuit 130 selects the lower region and upper region one by one in this order, like lower, upper, lower, upper, . . . , in an alternating manner. In the second field, the scanning-line driving circuit 130 selects the upper region and lower region one by one in this order, like upper, lower, upper, lower . . . , in an alternating manner. In either field, the scanning lines 112 are selected on a one-by-one basis from top to bottom in each region. Therefore, in the present embodiment, each of the scanning lines 112 is selected once in each of the first and second fields, i.e., is selected twice in total in one frame.

Figure 5:
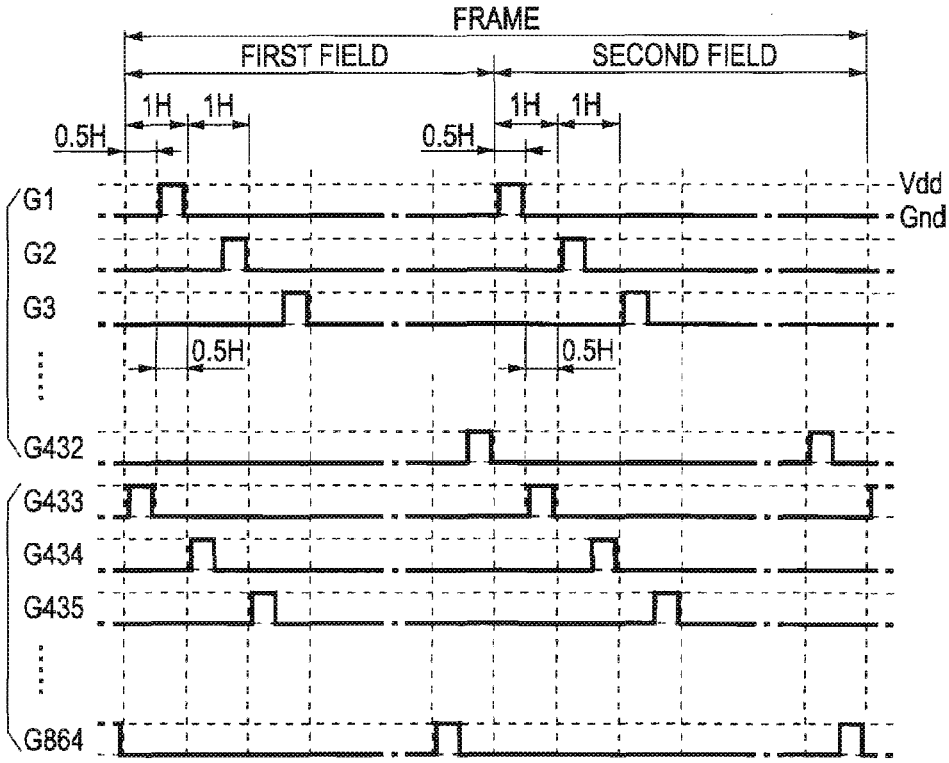
FIG. 5 illustrates how vertical scanning is performed by the electro-optical device.

FIG. 5 illustrates waveforms of the scan signals G1, G2, G3, . . . , and G864 supplied from the scanning-line driving circuit 130 when the scanning lines are selected on a one-by-one basis in order in such a manner. FIG. 5 shows a state in which a scan signal for a scanning line selected in a period of 0.5 H is at H level corresponding to a selection voltage Vdd in a period smaller than the 0.5 H period and other scan signals are at L level corresponding to a non-selection voltage (ground potential Gnd).

In practice, the scanning-line driving circuit 130 outputs the scan signals G1, G2, G3, . . . , and G864 by reducing a pulse width of each of shift signals in which start pulses Dy are sequentially transferred in response to clock signals Cly into either an enable signal Enb1 or Enb2. The detailed structure thereof is described in, for example, JP-A-2004-177930, so further description thereof is omitted.

The block selecting circuit 140 outputs shift signals S1, S2, S3, . . . , S191, and S192 to the blocks B1, B2, B3, . . . , B191, and B192, respectively, by transferring a start pulse Dx in a direction specified by a transfer-direction specifying signal Dir in response to a clock signal Clx. The shift signals S1, S2, S3, . . . , S191, and S192 are made to be H level one by one in a period during which a selection voltage is applied to a corresponding selected scanning line. More specifically, when the transfer-direction specifying signal Dir is at H level and the rightward transfer is specified, the block selecting circuit 140 sets the shift signals S1, S2, S3, . . . , S191, and S192 at H level one by one in this order. When the transfer-direction specifying signal Dir is at L level and the left direction transfer is specified, the block selecting circuit 140 sets the shift signals S192, S191, . . . , S3, S2, and S1 at H level one by one in this order. Each of the blocks is in a selected state when the shift signal corresponding thereto is at H level.

An OR circuit 142 is provided for each block. The OR circuit 142 finds a logical sum signal of an output shift signal corresponding to a block associated with the OR circuit 142 and a signal Nrg specifying a precharge and outputs the logical sum signal as a sampling signal for the sampling circuit 150, which will be described next.

The sampling circuit 150 is a collection of TFTs 151 each provided for each of the data lines 114 and functioning as a sampling switch.

A drain of each of the TFTs 151 is connected to a first end of the data line 114. Gates of the TFTs 151 corresponding to the six data lines 114 belonging to the same block receive a common sampling signal corresponding to the block. For example, the gates of the six TFTs 151 corresponding to the 7th to 12th data lines 114 belonging to the block B2 receive a sampling signal corresponding to the block B2, i.e., a common logic sum signal corresponding to the block B2 from the OR circuit 142.

For the display panel 10, the data signals Vid1 to Vid6 from the processing circuit 30 are supplied to six image signal lines 171. The six image signal lines 171 are connected to the sources of the TFTs 151 as described below.

That is, when the drain of a TFT 151 is connected to a first end of a jth data line 114 counting from left in FIG. 2, if the remainder of the division of j by 6 is 1, the source of the TFT is connected to an image signal line 171 that receives the data signal Vid1. Similarly, if the remainder of the division of j by 6 is 2, 3, 4, 5, and 0, the source of the TFT 151 is connected to image signal lines 171 that receive the data signals Vid2, Vid3, Vid4, Vid5, and Vid6, respectively.

For example, in FIG. 2, the source of a TFT 151 whose drain is connected to the 11th data line 114 is connected to an image signal line 171 that receives the data signal Vid5 because the remainder of the division of 11 by 6 is 5.

Next, operations in the electro-optical device 1 will be described.

Figure 4:
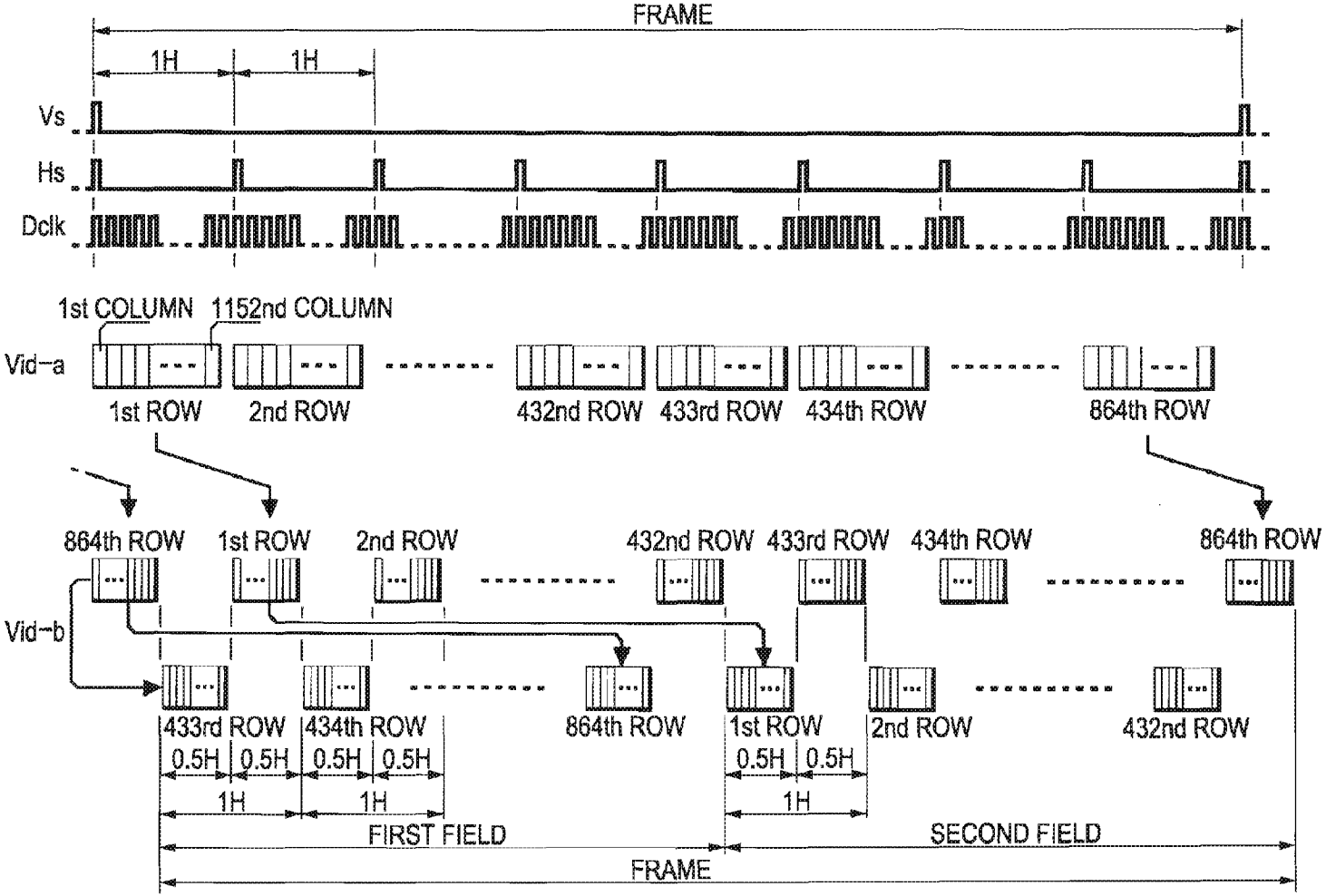
FIG. 4 illustrates how display data is stored and read by the electro-optical device.

First, as illustrated in FIG. 4, the display data Vid-a is supplied from an external host circuit in one frame period in an order of pixels of the 1st row and 1st column through 1st row and 1152nd column, 2nd row and 1st column through 2nd row and 1152nd column, 3rd row and 1st column through 3rd row and 1152nd column, . . . , to 864th row and 1st column through 864th row and 1152nd column. At this time, a period of one frame is determined by a vertical synchronous signal Vs, a horizontal scan period is determined by a horizontal synchronous signal Hs, and a period during which display data for one pixel is supplied is determined by one cycle of the dot clock signal Dclk.

The display data Vid-a is temporarily stored in the storage circuit 310. When display data for one row of the display data Vid-a is stored in the storage circuit 310, the data is read at a speed twice the storing speed, and after a period of time of ½ frame passes, the data is read at the double speed again. When display data for one row is read at the double speed, the reading is complete in a period half the horizontal scan period 1 H, i.e., 0.5 H. Therefore, a remaining period 0.5 H is available. In the present embodiment, in this period 0.5 H, the display data after a period of ½ frame passes is read at the double speed again.

As a result, in the present embodiment, as illustrated in FIG. 4, the display-data Vid-b is read in order of the (433rd), 1st, (434th), 2nd, (435th), 3rd, . . . , (864th), 432nd, (1st), 433rd, (2nd), 434th, . . . , (432nd), and 864th rows.

In the present embodiment, a period during which the display data Vid-b for the (433rd), 1st, (434th), 2nd, (435th), 3rd, . . . , (864th), and 432nd rows is read is set as the first field, and a period during which the display data Vid-b for the (1st), 433rd, (2nd), 434th, . . . , (432nd), and 864th rows is read is set as the second field.

The row numbers in parentheses indicate second reading. More specifically, among rows of data read in the first field, display data Vid-b for the (433rd), (434th), (435th), . . . , and (864th) rows, which belong to the lower region, is re-read after having been read in a second field in the previous frame. Among rows of data read in the second field, display data Vid-b for the (1st), (2nd), (3rd), . . . and (432nd) rows, which belong to the upper region, is re-read after having been read in the first field.

The control circuit 20 controls the scanning-line driving circuit 130 to operate so as to match with a row of display data Vid-b read from the storage circuit 310. For example, the control circuit 20 controls display data Vid-b such that, in the first field, in a period for which display data Vid-b for the (433rd) row is read, the scan signal G433 is at H level and such that, in a period for which display data Vid-b for the 1st row is read, the scan signal G1 is at H level. For example, the control circuit 20 controls display data Vid-b such that, in the second field, in a period for which display data Vid-b for the (2nd) row is read, the scan signal G2 is at H level and such that, in a period for which display data Vid-b for the 434th row is read, the scan signal G434 is at H level.

In the present embodiment, a frame period and a horizontal scan period determined by read display data Vid-b (i.e., when the display panel 10 is scanned) lag by 0.5 H behind a frame period and a horizontal scan period determined by display data Vid-a supplied from the external host circuit. In the present embodiment, however, for the sake of describing a scan of the display panel 10, a period determined by the read display data Vid-b is a standard unless otherwise specified.

In the present embodiment, in the first and second fields, display data Vid-b is read from the storage circuit 310 in an order of rows described above at double speed. In the present embodiment, an order of reading columns may or may not be an order of the 1st to 1152nd columns corresponding to a storing direction. In other words, a transfer direction (a direction of selecting a block) is specified for each row in the first and second fields, as illustrated in FIG. 6.

More specifically, when a scanning line 112 belonging to the upper region is generally represented by an ith row (i.e., i is an integer that satisfies $1 \leqq i \leqq 432$), in the first field, a scanning line 112 of an (i+432)th row in the lower region is selected before the scanning line 112 of the ith row is selected. When i is an odd number (1, 3, 5, . . . , and 431), if the scanning line 112 of the (i+432)th row in the lower region is selected, rightward transfer is specified; if the scanning line 112 of the ith row in the upper region is selected, leftward transfer is specified. When i is an even number (2, 4, 6, . . . , and 432), if the scanning line 112 of the (i+432)th row is selected, the leftward transfer is specified; if the scanning line 112 of the ith row is selected, the rightward transfer is specified.

In the second field, the scanning line 112 of the (i+432)th row in the lower region is selected after the scanning line 112 of the ith row is selected. When i is an odd number, if the scanning line 112 of the ith row in the upper region is selected, the rightward transfer is specified; if the scanning line 112 of the (i+432)th row in the lower region is selected, the leftward transfer is specified. When i is an even number, if the scanning line 112 of the ith row in the upper region is selected, the leftward transfer is specified; if the scanning line 112 of the (i+432)th row is selected, the rightward transfer is specified.

Therefore, in terms of a period of one frame, for each row, each of the rightward transfer and the leftward transfer is performed once. Additionally, in terms of each of the first field and the second field, for each of the upper region and the lower region, the rightward transfer and the leftward transfer are alternately specified.

When the rightward transfer is specified, a selection order is the same as an order corresponding to the storage direction of the 1st through 1152nd columns. When the leftward transfer is specified, an order of selecting blocks is B192, B191, . . . , B2, to B1, and in each selected block, lines are selected one by one from left to right. (The reason for this irregular selection order will be described below.)

In the first field and the second field, when display data Vid-b for each row is read and data in which the display data Vid-b is phase-expanded is converted into data signals, the control circuit 20 specifies a polarity for writing, as illustrated in FIG. 6, with respect to the inversion/non-inversion circuit 340.

More specifically, in the first field, when the scanning line 112 of the (i+432)th row in the lower region is selected, negative writing is specified, and when the scanning line 112 of the ith row in the upper region is selected, positive writing is specified. In the second field, when the scanning line 112 of the ith row in the upper region is selected, the negative writing is specified, and when the scanning line 112 of the (i+432)th row in the lower region is selected, the positive writing is specified. Therefore, in each row, the positive writing and the negative writing are performed.

As illustrated in FIG. 6, the first field alternately repeats the following two patterns: a first pattern in which, when i is an odd number, the rightward transfer and the negative writing are specified for selection of the scanning line 112 of the (i+432)th row in the lower region and the leftward transfer and the positive writing are specified for selection of the scanning line 112 of the ith row in the upper region and a second pattern in which, when i is an even number, the leftward transfer and the negative writing are specified for selection of the scanning line 112 of the (i+432)th row and the right transfer and the positive writing are specified for selection of the scanning line 112 of the ith row. The first pattern is referred to as pattern A, and the second pattern is referred to as pattern B.

Similarly, the second field alternately repeats the following two patterns: a third pattern in which, when i is an odd number, the rightward transfer and the negative writing are specified for selection of the scanning line 112 of the ith row in the upper region and the leftward transfer and the positive writing are specified for selection of the scanning line 112 of the (i+432)th row in the lower region and a fourth pattern in which, when i is an even number, the leftward transfer and the negative writing are specified for selection of the scanning line 112 of the ith row and the right transfer and the positive writing are specified for selection of the scanning line 112 of the (i+432)th row. The third pattern is referred to as pattern C, and the fourth pattern is referred to as pattern D.

In the first field in one frame with respect to scanning of the display panel 10, first, the scanning line 112 of the 433rd row is selected, and then, the scanning line 112 of the 1st row is selected. Operations of such selection (i.e., pattern A) will now be described.

Figure 9:
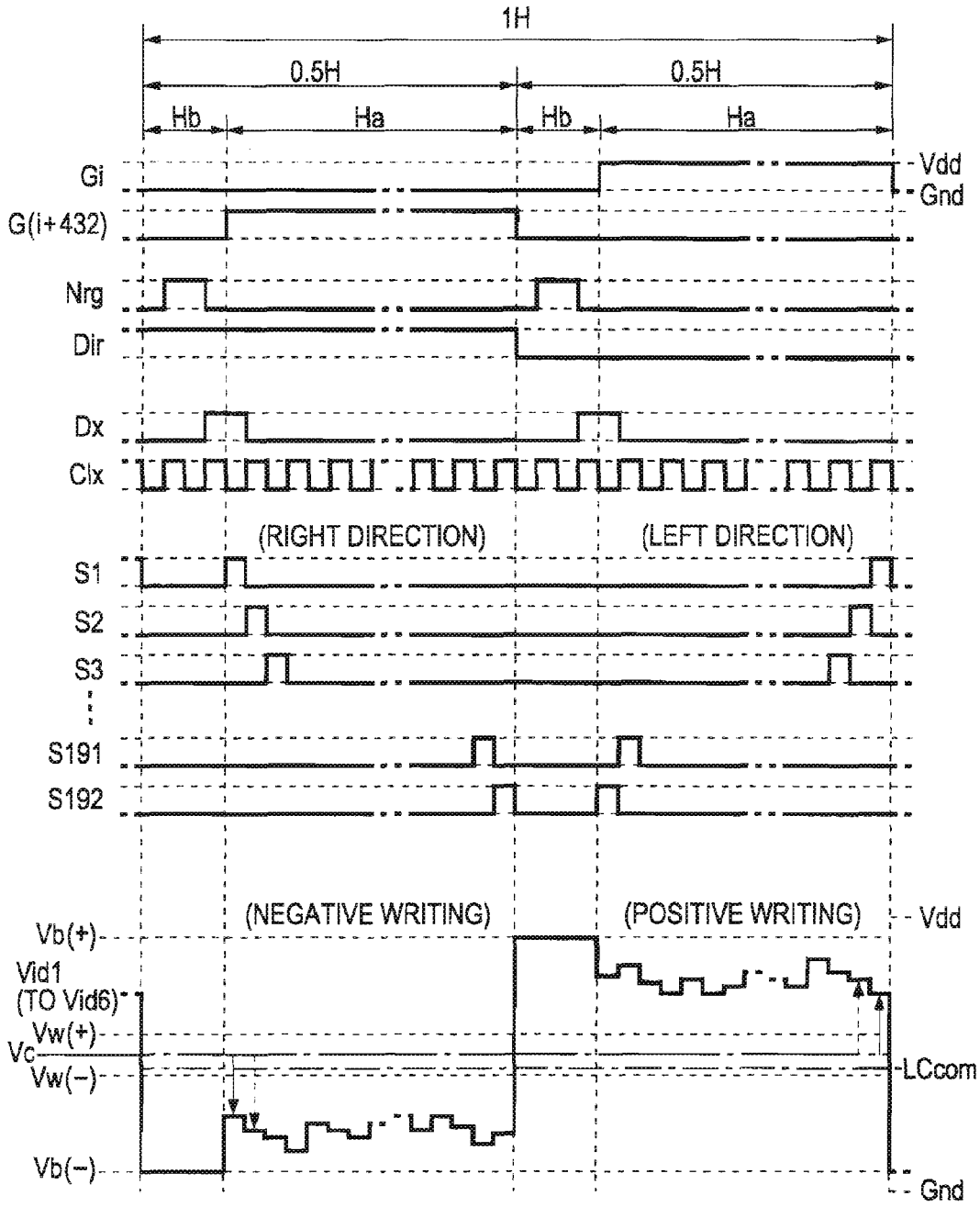
FIG. 9 illustrates how a horizontal scan corresponding to a first pattern is performed by the electro-optical device.

First, the control circuit 20 sets the signal Nrg in a part of a retrace time Hb before an effective scan period Ha at which the scan signal G433 is at H level (in FIG. 9, the scan signal G433 when i=1). The precharge voltage generating circuit 350 sets the precharge signal Vpre at a voltage Vb(−) corresponding to the negative writing specified for the 433th row. When the signal Nrg is at H level, the selector 360 selects the precharge signal Vpre, and therefore, the voltage Vb(−) of the precharge signal Vpre is applied to the six image signal line 171.

When the signal Nrg is at H level, irrespective of the logic levels of the shift signals S1, S2, S3, . . . , S191, and S192, the logic sum signals of the OR circuits 142 are all at H level. Therefore, since all the TFTs 151 are in the on state, all the data lines 114 of the 1st to 1152nd columns are precharged to the voltage Vb(−). As a result, all the data lines 114 of the 1st to 1152nd columns are in an initial state before a voltage of the data signal is written. If the TFTs 151 are in the off state, each of the data lines 114 maintains a precharged voltage by means of its parasitic capacitance.

Then, when the signal Nrg is at L level, the selector 360 selects the data signal Vd1 to Vd6 from the inversion/non-inversion circuit 340, and the on and off states of each of the TFTs 151 are determined by the logic level of the shift signal.

When the scanning line of the 433rd row is selected in the first field, as illustrated in FIG. 6, the rightward transfer and the negative writing are specified. Therefore, first, the control circuit 20 sets a transfer-direction specifying signal Dir at H level. As illustrated in FIG. 9, a start pulse Dx supplied at the start of the effective scan period Ha is transferred rightward, and thus the shift signals S1, S2, S3, . . . , S191, and S192 are sequentially made to be at H level one by one in this order in the effective scan period Ha.

The control circuit 20 controls the scanning-line driving circuit 130 to set the scan signal G433 at H level in this effective scan period Ha.

When the scanning line of the 433rd row is selected in the first field, the control circuit 20 reads display data Vid-b corresponding to the pixels 110 at the intersections of the 433rd row and the 1st, 2nd, 3rd, 4th, . . . , and 1152nd columns in this order from the storage circuit 310 at double speed.

Figure 7:
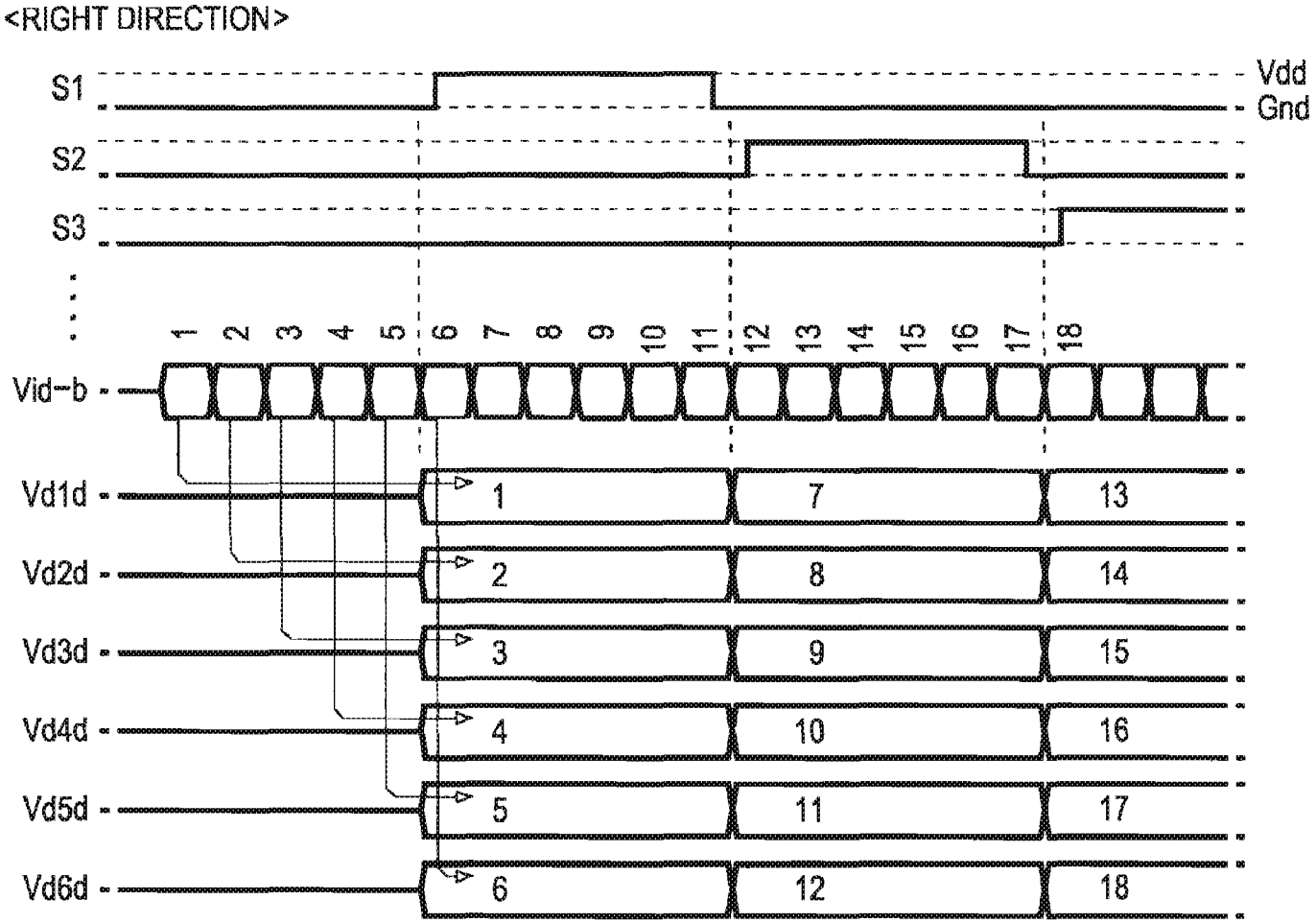
FIG. 7 illustrates how a rightward phase expansion is performed by the electro-optical device.

As illustrated in FIG. 7, the control circuit 20 causes the S/P conversion circuit 320 to expand the read display data Vid-b corresponding to the 1st to 6th columns so as to match with a period at which the shift signal S1 is at H level by six times with respect to the time base and causes the display data segments corresponding to the 1st to 6th columns to be distributed in order of the display data segments Vd1 to Vd6. The distributed display data segments Vd1 to Vd6 are converted into respective analog signals by the D/A conversion circuit group 330, and are converted into negative signals by the inversion/non-inversion circuit 340. Therefore, the display data segments Vd1 to Vd6 are output as the data signals Vid1 to Vid6.

Therefore, the data signal Vid1 has a negative voltage corresponding to a gray scale level of a pixel 110 of the 433rd row and 1st column. Similarly, the data signals Vid2 to Vid6 have negative voltages corresponding to gray scale levels of pixels 110 of the 433rd row and the 2nd column to 433rd row and 6th column, respectively.

When the shift signal S1 is at H level, the TFTs 151 of the 1st to 6th columns belonging to the block B1 are in the on state. Therefore, the negative-voltage data signal Vid1 corresponding to a gray scale level of the pixel 110 of the 433rd row and the 1st column is sampled into the data line 114 of the 1st column. Similarly, the negative-voltage data signals Vid2 to Vid6 corresponding to gray scale levels of the pixels 110 of the 433rd row and the 2nd column to the 433rd row and the 6th column are sampled into the data lines 114 of the 2nd to 6th columns, respectively.

Since the scan signal G433 is at H level, all the TFTs 116 whose gates are connected to the scanning line 112 of the 433rd row are in the on state. Therefore, the voltage of the data signal Vid1 sampled in the data line 114 of the 1st column is applied to the pixel electrode 118 of the 433rd row and 1st column, which corresponding to the intersection of the scanning line 112 of the 433rd row and the data line 114 of the 1st column. Similarly, the voltages of the data signals Vid2 to Vid6 sampled in the data lines 114 of the 2nd to 6th columns are applied to the pixel electrodes 118 corresponding to the intersections of the 433rd row and the 2nd column to the 433rd row and the 6th column, respectively.

Subsequent to the shift signal S1, the shift signal S2 is at H level. The control circuit 20 causes the read display data Vid-b corresponding to the 7th to 12th columns to be expanded by six times so as to match with a period at which the shift signal S2 is at H level and causes the display data segments corresponding to the 7th to 12th columns to be distributed in order of the display data segments Vd1 to Vd6. The distributed display data segments Vd1 to Vd6 are converted into respective negative signals and then output as the data signals Vid1 to Vid6.

When the shift signal S2 is at H level, the TFTs 151 of the 7th to 12th columns belonging to the block B2 are in the on state. Therefore, the data signal Vid1 corresponding to a gray scale level of the pixel 110 at the intersection of the 433rd row and the 7th column is sampled into the data line 114 of the 7th column. Similarly, the data signals Vid2 to Vid6 corresponding to gray scale levels of the pixels 110 at the intersections of the 433rd row and the 8th column to the 433rd row and the 12th column are sampled into the data lines 114 of the 8th to 12th columns, respectively.

Since the scan signal G433 is still at H level, the voltage of the data signal Vid1 sampled in the data line 114 of the 7th column is applied to the pixel electrode 118 corresponding to the intersection of the 433rd row and the 7th column. Similarly, the voltages of the data signals Vid2 to Vid6 sampled in the data lines 114 of the 8th to 12th columns are applied to the pixel electrodes 118 corresponding to the intersections of the 433rd row and the 8th column to the 433rd row and the 12th column, respectively.

In a period for which the scanning line 112 of the 433rd row is selected in the first field, the same operation repeats until the shift signal S192 is at H level. Therefore, the negative voltages corresponding to the gray scale levels are applied to the pixel electrodes 118 of the intersections of the 433rd row and the 1st column to the 433rd row and the 1152nd column, respectively.

Subsequent to the 433rd row in the first field, the scanning line 112 of the 1st row is selected. As illustrated in FIG. 6, when the scanning line 112 of the 1st row is selected, the leftward transfer and the positive writing are specified. Therefore, the control circuit 20 sets the transfer-direction specifying signal Dir at L level. As a result, as illustrated in FIG. 9 (scan signal G1 when i=1), a start pulse Dx supplied at the start of an effective scan period Ha is shifted leftward, and thus the shift signals S192, S191, . . . , S3, S2, and S1 are sequentially made to be at H level one by one in this order in the effective scan period Ha. The control circuit 20 controls the scanning-line driving circuit 130 to set the scan signal G1 at H level in this effective scan period Ha.

Figure 8:
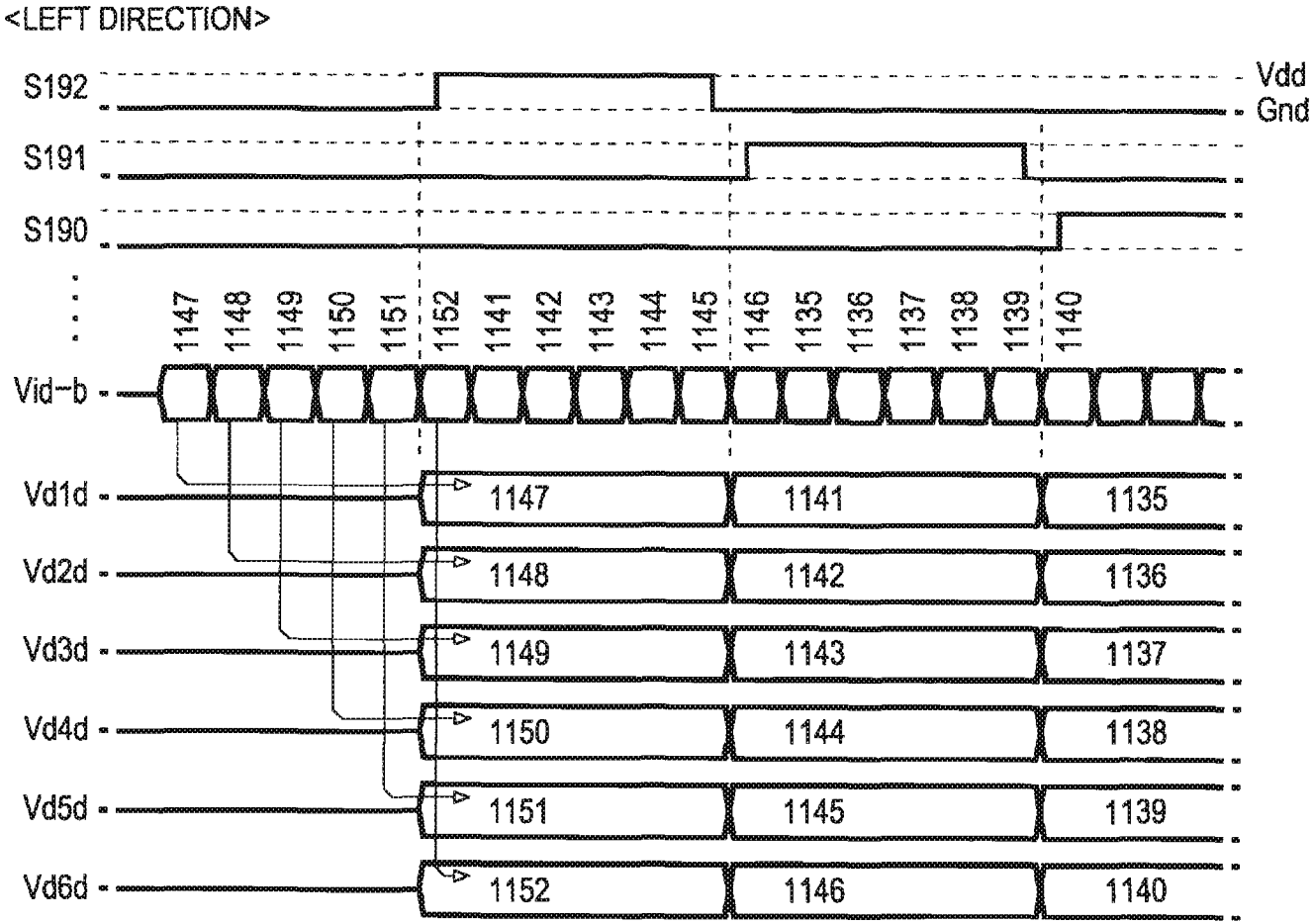
FIG. 8 illustrates how a leftward phase expansion is performed by the electro-optical device.

When the scanning line of the 1st row is selected in the first field, with respect to six columns belonging to each of the blocks B192, B191, . . . , B3, B2, and B1 of the 1st row, the control circuit 20 reads, from left to right, i.e., as illustrated in FIG. 8, display data Vid-b corresponding to the pixels 110 corresponding to the intersections of the 1147th to 1152nd columns, 1141st to 1146th columns, 13th to 18th columns, 7th to 12th columns, and 1st to 6th columns in this order from the storage circuit 310 at double speed.

First, as illustrated in FIG. 8, the control circuit 20 causes the read display data Vid-b corresponding to the 1147th to 1152nd columns to be expanded by six times with the time base so as to match with a period at which the shift signal S192 is at H level and causes the display data segments corresponding to the 1147th to 1152nd columns to be distributed in order of the display data segments Vd1 to Vd6. The distributed display data segments Vd1 to Vd6 are converted into respective analog signals and converted into respective positive signals by the inversion/non-inversion circuit 340. The signals are output as the data signals Vid1 to Vid6.

Therefore, the data signal Vid1 is made to have a positive voltage corresponding to a gray scale level for the pixel 110 corresponding to the intersection of the 1st row and 1147th column. Similarly, the data signals Vid2 to Vid6 are made to have positive voltages corresponding to gray scale levels for the pixels 110 corresponding to the intersections of the 1st row and the 1148th column to the 1st row and 1152nd column, respectively.

In a period for which the scanning line 112 of the 1st row is selected in the first field, the same operation repeats until the shift signal S191, . . . , S3, S2, and S1 are made to be at H level one by one. Therefore, the positive voltages corresponding to the gray scale levels are applied to the pixel electrodes 118 of the intersections of the 1st row and the 1152nd column to the 1st row and the 1st column, respectively.

When the scanning lines 112 of the 433rd and 1st rows are selected in the first field, as described above, the scanning line 112 of the 434th row is then selected, and then the scanning line 112 of the 2nd row is selected. Operations of such selection (i.e., pattern B) will now be described.

Figure 10:
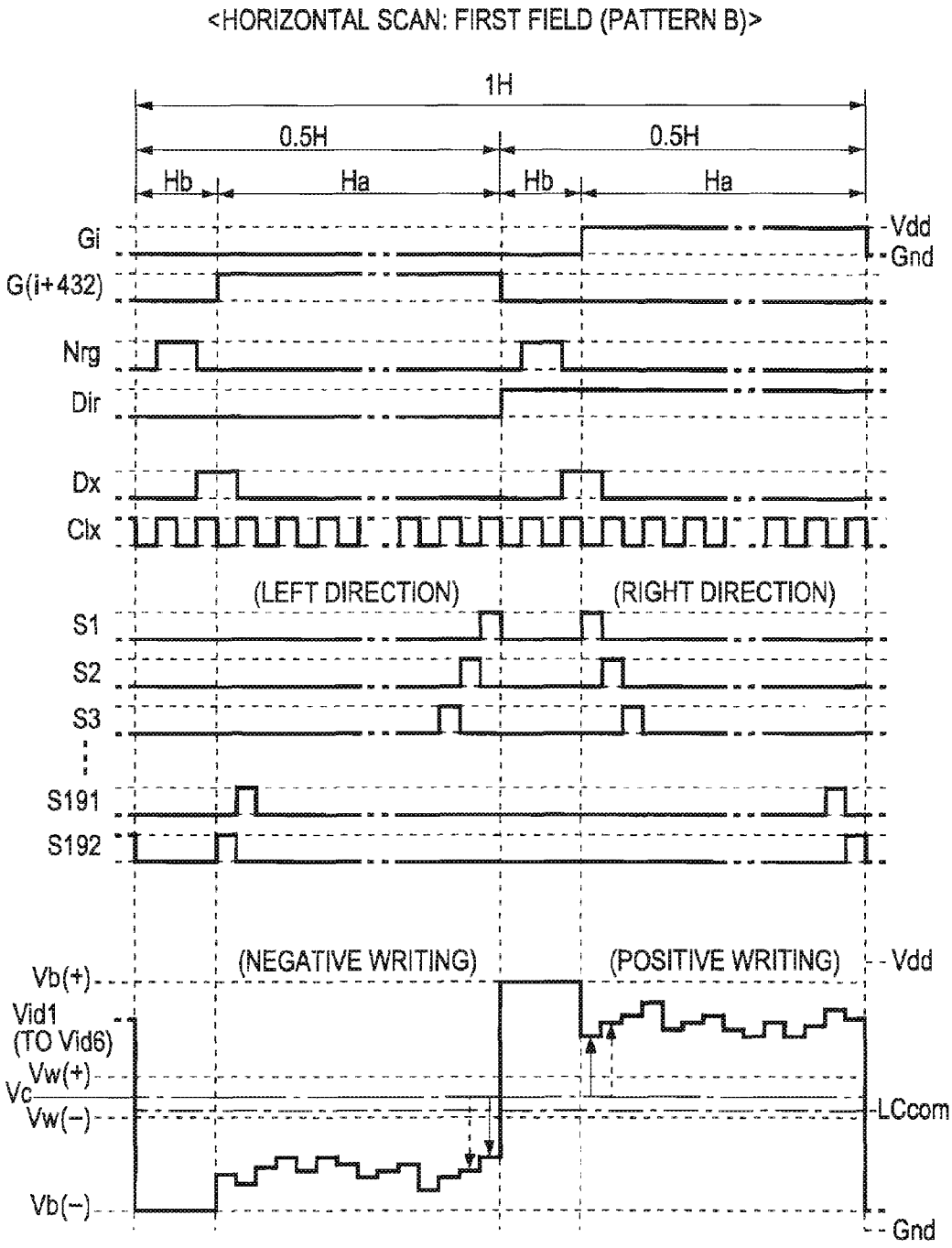
FIG. 10 illustrates how the horizontal scan corresponding to a second pattern is performed by the electro-optical device.

When the scanning line 112 of the 434th row is selected, the leftward transfer and the negative writing are specified, as illustrated in FIG. 6. Therefore, the control circuit 20 maintains the transfer-direction specifying signal Dir at L level. As a result, as illustrated in FIG. 10 (scan signal G434 when i=2), the shift signals S192, S191, . . . , S3, S2, and S1 are made to be at H level one by one in this order in an effective scan period Ha. This is substantially the same as in writing for the 1st row, as previously described, with the difference that the writing polarity is negative. Accordingly, in a period for which the scanning line 112 of the 433rd row is selected in the first field, the shift signals S192, S191, . . . , S3, S2, and S1 are made to be at H level one by one. Therefore, the negative voltages corresponding to the gray scale levels are applied to the pixel electrodes 118 corresponding to the intersections of the 434th row and 1152nd column to 434th row and 1st column, respectively.

Subsequent to the 434th row in the first field, the scanning line 112 of the 2nd row is selected. As illustrated in FIG. 6, when the scanning line 112 of the 2nd row is selected, the rightward transfer and the positive writing are specified. Therefore, the control circuit 20 inverts the level of the transfer-direction specifying signal Dir to H level. As a result, as illustrated in FIG. 10 (scan signal G2 when i=2), the shift signals S1, S2, S3, . . . , S191, and S192 are made to he at H level one by one in this order in an effective scan period Ha. This is substantially the same as in writing for the 433rd row, as previously described, with the difference that the writing polarity is positive. Accordingly, in a period for which the scanning line 112 of the 2nd row is selected in the first field, the shift signals S1, S2, S3, . . . , S191, and S192 are made to be at H level one by one. Therefore, the positive voltages corresponding to the gray scale levels are applied to the pixel electrodes 118 corresponding to the intersections of the 2nd row and 1st column to 2nd row and 1152nd column, respectively.

In the first field, pattern A and pattern B repeat until the scanning line 112 of the 864th row and that of the 432nd row are selected. Therefore, in the upper region, a positive voltage corresponding to a gray scale level is written by the leftward transfer for an odd-numbered row and in the rightward transfer for an even-numbered row. In the lower region, a negative voltage corresponding to a gray scale level is written by the rightward transfer for an odd-numbered row and in the leftward transfer for an even-numbered row.

Next, operations in a second field is described. In the second field, first, the scanning line 112 of the 1st row is selected, and then, the scanning line 112 of the 433rd is selected. Operations of such selection (i.e., pattern C) will be described.

Figure 11:
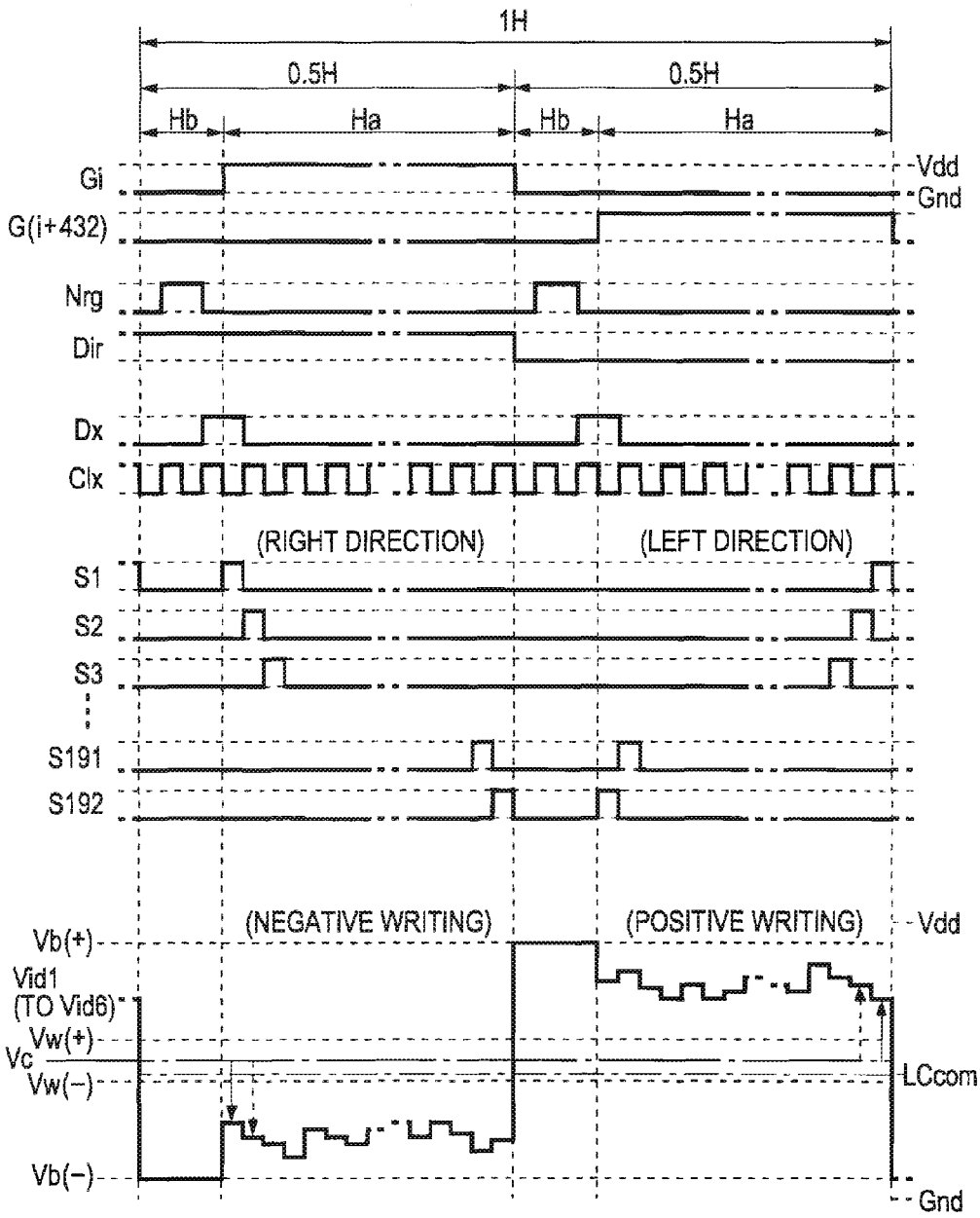
FIG. 11 illustrates how the horizontal scan corresponding to a third pattern is performed by the electro-optical device.

When the scanning line 112 of the 1st row is selected in the second field, the rightward transfer and the negative writing are specified, as illustrated in FIG. 6. Therefore, as illustrated in FIG. 11 (scan signal G1 when i=1), in an effective scan period Ha, the shift signals S1, S2, S3, . . . , S191, and S192 are made to be at H level one by one in this order. Then, when the scanning line 112 of the 433rd row is selected, the leftward transfer and the positive writing are specified. Therefore, as illustrated in FIG. 11 (scan signal G433 when i=1), in an effective scan period Ha, the shift signals S192, S191, . . . , S3, S2, and S1 are made to be at H level one by one in this order.

This is opposite to both the transfer direction and the writing polarity in a writing operation for the same row in the first field. Therefore, in the second field, in a period for which the scanning line 112 of the 1st row is selected, a negative voltage corresponding to a gray scale level is applied to each of the pixel electrodes 118 corresponding to the intersections of the 1st row and the 1st column to the 1st row and the 1152nd column; in a period for which the scanning line 112 of the 433rd row is selected, a positive voltage corresponding to a gray scale level is applied to each of the pixel electrodes 118 corresponding to the intersections of the 433rd row and the 1152nd column to the 433rd row and the 1st column.

When the scanning line 112 of the 1st row and that of the 433rd row are selected in the second field, the data line 114 of the 2nd row is then selected, and then the scanning line 112 of the 434th row is selected. Operations of such selection (i.e., pattern D) will now be described.

Figure 12:
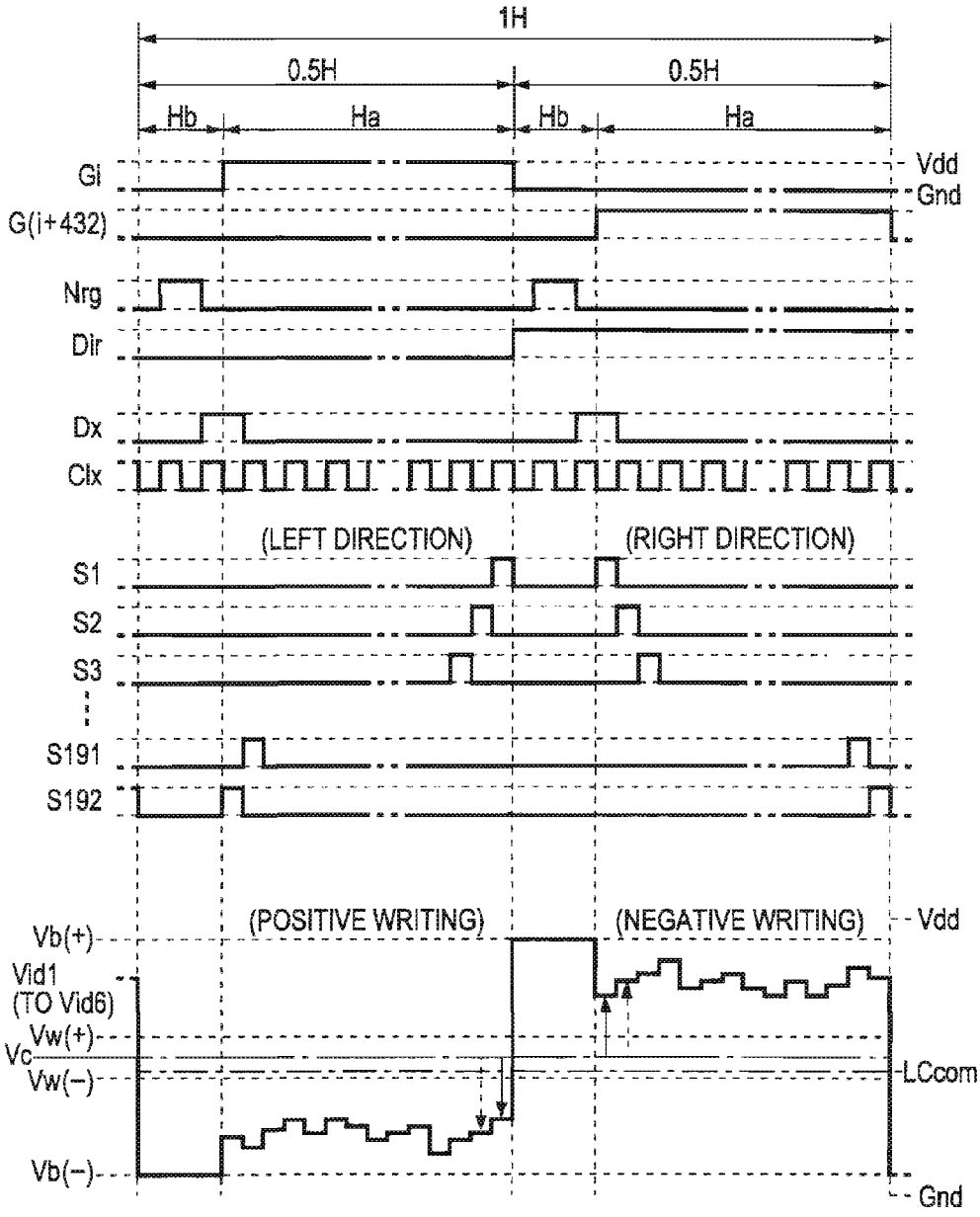
FIG. 12 illustrates how the horizontal scan corresponding to a fourth pattern is performed by the electro-optical device.

When the scanning line 112 of the 2nd row is selected in the second field, the leftward transfer and the negative writing are specified, as illustrated in FIG. 6. Therefore, as illustrated in FIG. 12 (scan signal G2 when i=2), the shift signals S192, S191, . . . , S3, S2, and S1 are made to be at H level one by one in this order in an effective scan period Ha. Then, when the scanning line 112 of the 434th row is selected, the rightward transfer and the positive writing are specified. Therefore, as illustrated in FIG. 12 (scan signal G434 when i=2), the shift signals S1, S2, S3, . . . , S191, and S192 are made to be at H level one by one in this order in an effective scan period Ha.

This is also opposite to both the transfer direction and the writing polarity in a writing operation for the same row in the first field. Therefore, in the second field, in a period for which the scanning line 112 of the 2nd row is selected, a negative voltage corresponding to a gray scale level is applied to each of the pixel electrodes 118 corresponding to the intersections of the 2nd row and the 1152nd column to the 2nd row and the 1st column; in a period for which the scanning line 112 of the 434th row is selected, a positive voltage corresponding to a gray scale level is applied to each of the pixel electrodes 118 corresponding to the intersections of the 434th row and the 1st column to the 434th row and the 1152nd column.

In the second field, pattern C and pattern D repeat until the scanning line 112 of the 432nd row and that of the 864th row are selected. Therefore, in the upper region, a negative voltage corresponding to a gray scale level is written by the rightward transfer for an odd-numbered row and in the leftward transfer for an even-numbered row. In the lower region, a positive voltage corresponding to a gray scale level is written by the leftward transfer for an odd-numbered row and in the rightward transfer for an even-numbered row.

Such an operation of writing a voltage corresponding to a gray scale level in the first and second fields forms an image for one frame.

As illustrated in FIGS. 9 to 12, for the positive writing, the data signal Vid1 (to Vid6) is a voltage higher than the reference voltage Vc by the amount corresponding to a gray scale level of a pixel in a range of from the voltage Vb(+), which corresponds to black (lowest gray scale level), to the voltage Vw(+), which corresponds to white (highest gray scale level); for the negative writing, the data signal Vid1 (to Vid6) is a voltage lower than the reference voltage Vc by the amount corresponding to a gray scale level of a pixel in a range of from the voltage Vb(−), which corresponds to black, to the voltage Vw(−), which corresponds to white.

In the present embodiment, the reference voltage Vc, which is a standard for the writing polarity, is set slightly higher than the voltage LCcom applied to the common electrode 108. This is because a parasitic capacitance between the gate and drain of the TFT 116 causes a phenomenon in which the potential of the drain (pixel electrode 118) decreases with a change from the on state to the off state (called field through or the like). To reduce degradation in liquid crystal, the liquid crystal capacitor 120 is driven by ac as a general rule. However, when the ac driving is performed by the use of the voltage LCcom applied to the common electrode 108 as a standard, a field-through phenomenon causes the rms value of voltage of the liquid crystal capacitor 120 in the negative writing to be slightly greater than that in the positive writing (when the TFT 116 is an n-channel TFT). Therefore, the reference voltage Vc for the writing polarity is set slightly higher than the voltage LCcom of the common electrode 108, thus contributing to cancellation of the effects of the field-through phenomenon.

Figure 13:
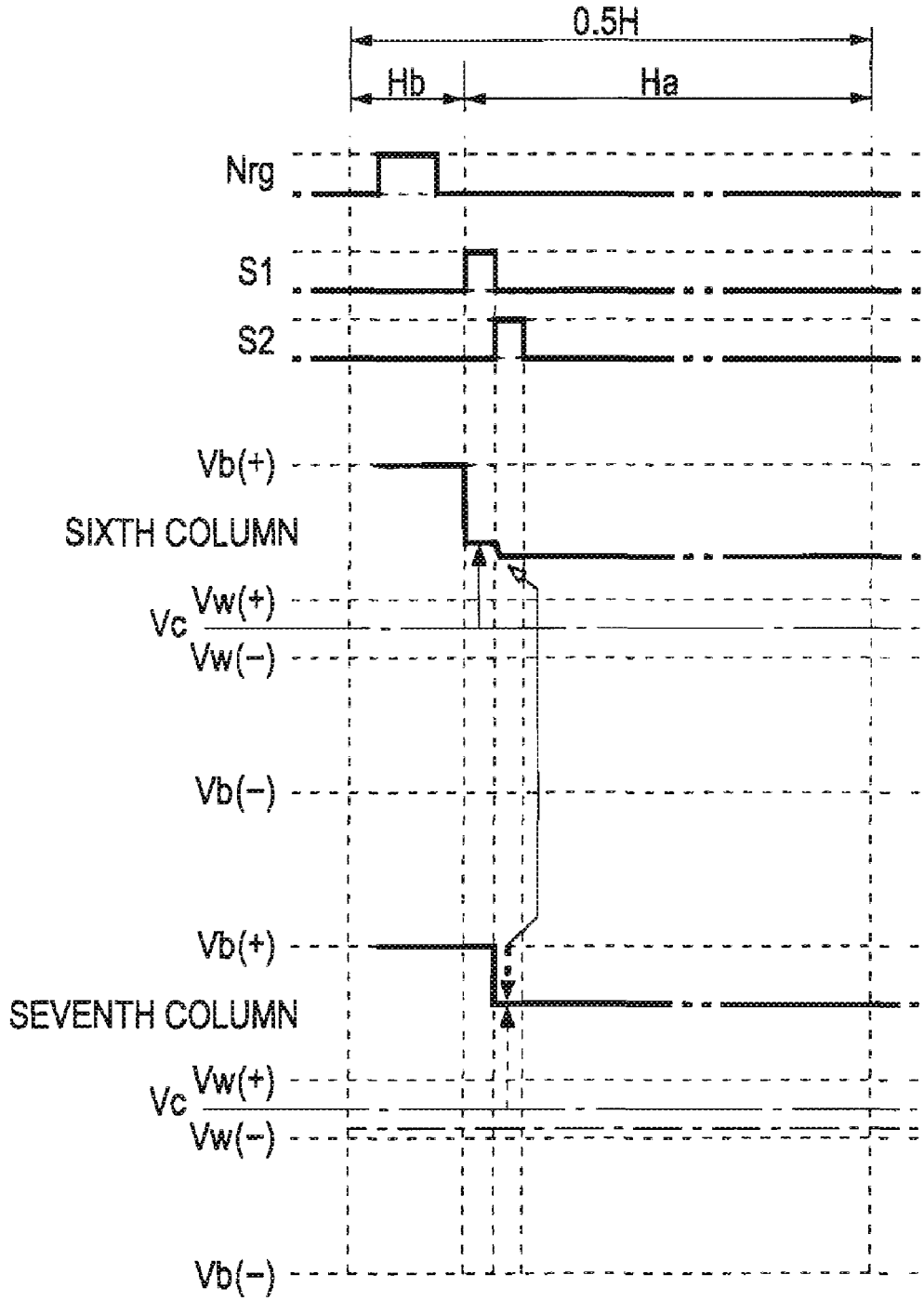
FIG. 13 illustrates a change in voltage of a data line according to the electro-optical device.

In FIGS. 9 to 12, the vertical scale for showing the magnitude of voltage of the data signal Vid1 (to Vid6) is enlarged, compared with the voltage waveforms of logic signals. In FIG. 13, the vertical scale for showing the magnitude of voltage of the data line is also enlarged, compared with the voltage waveforms of logic signals.

According to the present embodiment, a voltage corresponding to a gray scale level is written in a pixel in each row in each of first and second fields to which one frame is divided. At this time, for each row, each of rightward transfer and leftward transfer is performed once in one frame. Therefore, unevenness in display quality caused by the rightward transfer and that by the leftward transfer can cancel each other or be reduced by each other in units of one frame period. Accordingly, unevenness in display can be less recognizable.

For example, in a structure in which the data signals Vid1 to Vid6 are supplied to the image signal lines 171 from left, the effects of a wiring resistance and capacitor are small at the left on a screen. However, at the right on the screen, the effects thereof are larger than that at the left. A path for supplying a start pulse Dx and a clock signal Cx to the block selecting circuit 140 for the left on the screen is also different from that for the right. Additionally, although not described in the first embodiment, in a structure in which a pulse width of a shift signal is reduced into a sampling signal by use of an enable signal, a path for supplying the enable signal for the left on a screen is also different from that for the right. Therefore, even when a data signal having the same voltage is supplied, a voltage sampled in a data line in rightward transfer is different from that in leftward transfer. This causes display unevenness. In contrast to this, in the present embodiment, unevenness in display quality caused by the rightward transfer and that caused by the leftward transfer are leveled in one frame period. Therefore, display unevenness can be less recognizable.

Since each field is half one frame period, display unevenness in units of a field is originally less recognizable as flicker. In the present embodiment, if it is assumed that display unevenness in units of a field appears, since, in each field in both the upper region and lower region, the rightward transfer and the leftward transfer are alternately performed and thus adjacent rows have different transfer directions, the difference between the unevenness in display quality caused by the rightward transfer and that by the leftward transfer is less recognizable.

Figure 17A:
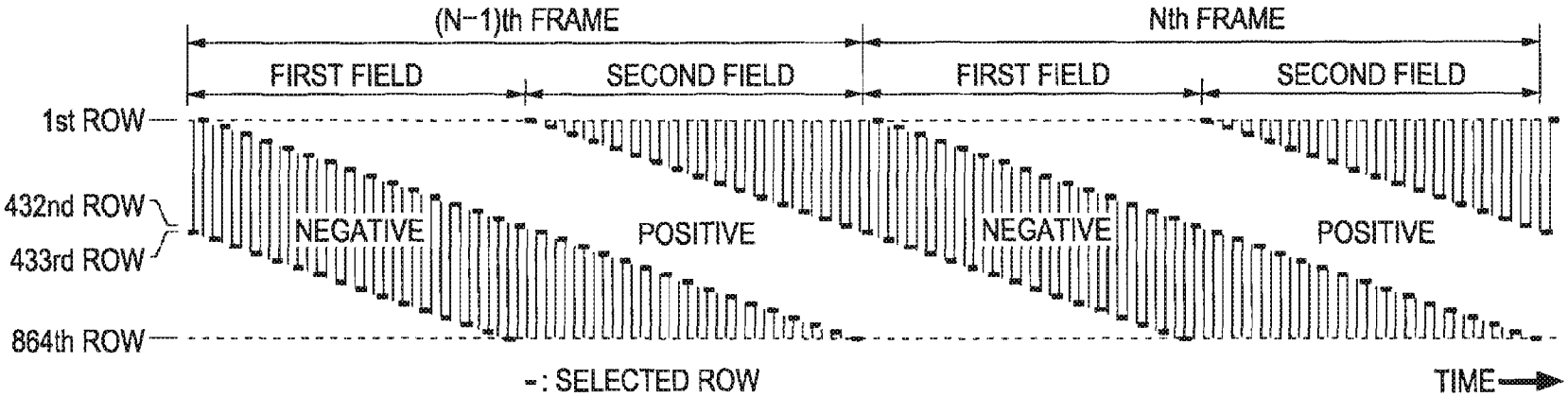
FIGS. 17A and 17B illustrate a writing state in the electro-optical device according to the first embodiment and that according to the second embodiment, respectively.

Changes in the writing polarity according to the first embodiment will now be described with reference to FIG. 17A. FIG. 17A illustrates how a writing state for each row changes with time over consecutive frames according to the first embodiment. FIG. 17A does not all writing operations for the scanning lines 112 of the 1st to 864th rows and schematically illustrates the writing operations in which some rows are omitted.

As illustrated in FIG. 17A, in the first embodiment, in the first field, negative writing is performed on pixels in the 433rd, 434th, 435th, . . . , and 864th row, positive writing is performed on pixels in the 1st, 2nd, 3rd, . . . , and 432nd rows, and this is maintained up to the next writing. In the second field, negative writing is performed on the pixels in the 1st, 2nd, 3rd, . . . , and 432nd rows, positive writing is performed on the pixel in the 433rd, 434th, 435th, . . . , and 864th row, and similarly, this is maintained up to the next writing. Therefore, in one frame period, ac driving to pixels is completed, and additionally, both the percentage of pixels maintaining positive voltage and the percentage of pixels maintaining negative voltage are 50% in any timing and any column. Accordingly, the polarities of the data lines 114 are balanced in a maintaining period. Therefore, the degrees of leaks of charges written in the pixel electrodes 118 via the TFTs 116 being in the off state are uniform in all rows, thus reducing display unevenness.

In the present embodiment, when a scanning line of a row is selected, pixels in that row have a writing polarity opposite to that in a scanning line of an adjacent upper row, but have the same writing polarity as in scanning lines of the other rows. Therefore, degradation in display quality caused by disclination (alignment defect) can also be reduced.

In the present embodiment, the data signals are simultaneously sampled into the six data lines 114. Display unevenness resulting from this simultaneous sampling can also be reduced. The details will now be described. For example, for the blocks B1 and B2, in the case of the rightward transfer, as illustrated in FIG. 13, the shift signals S1 and S2 are made to be at H level in this order.

When the shift signal S1 is at H level, the voltage of each of the data lines 114 of the 1st to 6th columns changes from a precharge voltage (for the positive writing, the voltage Vb(+)) to a voltage of a data signal corresponding to a gray scale level.

When the shift signal S1 is at L level, the data lines 114 of the 1st to 6th columns are in a high impedance state, which is not electrically connected. When the shift signal S2 is at H level, the voltage of each of the data lines 114 of the 7th to 12th columns changes from a precharge voltage to a voltage of a data signal corresponding to a gray scale level this time. Since the data lines 114 are close to their adjacent data lines 114, the data lines 114 are in a connected state in terms of capacitance. Therefore, when the voltage of the data line 114 of the 7th column changes, this voltage change displaces the voltage of the data line 114 of the 6th column being in a high-impedance state from a sampled voltage corresponding to a gray scale level (target voltage).

Since the scanning line 112 is maintained at H level in the effective scan period Ha, the voltage displaced from the target voltage is written into the data line 114 of the 6th column. In contrast, the voltage of each of the data lines 114 of the 1st to 5th columns is maintained at its target voltage because their adjacent data lines 114 does not change after voltages corresponding to gray scale levels are sampled. Strictly, the displacement of the voltage of the data line 114 of the 6th column from the target voltage causes the voltage of the data line 114 of the 5th column to be displaced from the target voltage. However, the displacement of the voltage of the data line 114 of the 6th column is smaller than a voltage change of the data line 114 of the 7th column, and therefore, the effects thereof are negligible.

As a result, in the case of the rightward transfer, of the data lines 114 of the 1st to 6th columns belonging to the block B1, only the voltage of the data line 114 of the 6th column is displaced from the target voltage. This appears as the difference in light intensity. Similar displacement from a target voltage occurs in the data lines 114 of the 12th, 18th, 24th, . . . , and 1146th columns, whose adjacent data lines 114 each have a voltage that changes after the target voltage is sampled. In the present embodiment, since there is no 1153rd column, displacement of the voltage of a data line from a target voltage after the target voltage is sampled resulting from the effects of a voltage change in the adjacent data line does not occur in the data line 114 of the 1152nd column.

Figure 14A:
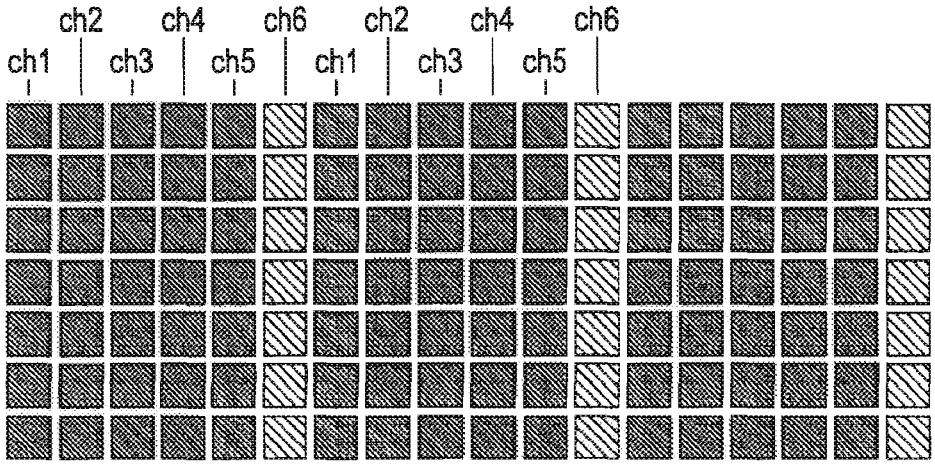
FIGS. 14A and 14B illustrate display unevenness and an improvement thereof according to the electro-optical device.

Therefore, as illustrated in FIG. 14A, in the case of rightward transfer, when the same gray scale level is to be displayed in the pixels in the data lines, the data lines corresponding to the channels ch1 to ch5 have the same gray scale level because these data lines maintain the target voltage, but the data lines corresponding to the channel ch6 have a different light intensity from the data lines corresponding to the channels ch1 to ch5 because the voltage of each of the data lines corresponding to the channel ch6 is displaced from the target voltage. The different light intensity extends in the column direction, thus resulting in recognizable vertical stripes.

Whether the data lines corresponding to the channel ch6 are brighter or darker than the other data lines depends on the precharge voltage and the mode (normally white mode or normally black mode), in the present embodiment, since the precharge voltage is the voltage Vb(+) or Vb(−), which correspond to black, the voltage of each of adjacent data lines changes in a direction in which the absolute value of a storage voltage of a liquid crystal capacitor becomes smaller. Therefore, in the case of the normally white mode, as illustrated in FIG. 14A, the data lines corresponding to the channel ch6 are brighter that the other data lines.

Figure 14B:
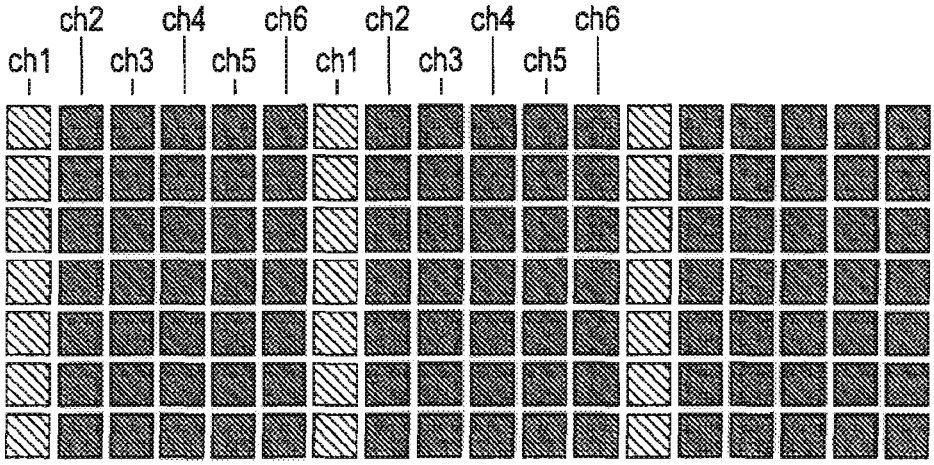

In the case of leftward transfer, a voltage change in adjacent data lines after voltages corresponding to gray scale levels are sampled occurs in the data lines of the 1147th, 1141st, . . . , 13th, and 7th columns (displacement of the voltage of the data line of the 1st column does not occurs from the reason described above). Therefore, as illustrated in FIG. 14B, in the case of the leftward transfer, when the same gray scale level is to be displayed in the pixels in the data lines, the data lines corresponding to the channel ch1 have a different light intensity from the data lines corresponding to the channels ch2 to ch6.

In the present embodiment, in one frame period, each of the rightward transfer and the leftward transfer is performed once. Therefore, the difference in light intensity occurring in each of the data lines 114 corresponding to the channels ch1 and ch6 is leveled down to half in terms of one frame period. As a result, according to the present embodiment, display unevenness resulting from simultaneous sampling of data signals into the six data lines 114 can be reduced.

In the present embodiment, the transfer directions and the writing polarities may be interchanged, respectively. For example, in the first field, negative writing may be performed in the upper region and positive writing may be performed in the lower region, and in the second field, the positive writing may be performed in the upper region and the negative writing may be performed in the lower region.

Second Embodiment

Figure 15:
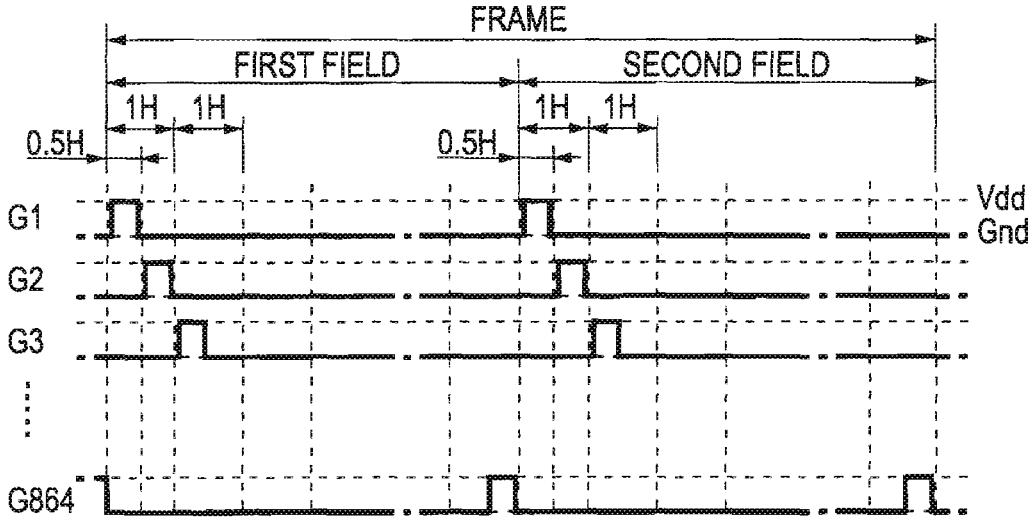
FIG. 15 illustrates how vertical scanning is performed by the electro-optical device according to a second embodiment.

Next, a second embodiment of the invention will be described. In the first embodiment described above, the display area 100 is divided to the upper region and the lower region for the sake of convenience. In the first field, the lower region and the upper region are selected in this order, like the lower, upper, lower, upper, . . . , in an alternating manner. In the second field, the upper region and the lower region are selected in this order like upper, lower, upper, lower, . . . , in an alternating manner. In each of the first field and the second field, the scanning lines are selected one by one in order from top in each of the upper region and the lower region. In the second embodiment, as illustrated in FIG. 15, in each of the first field and the second field, with respect to the scanning lines selected in a period of 0.5 H, the scan signals G1, G2, G3, and G864 are made to be at H level one by one in this order in a period smaller than the period 0.5 H.

Since an order of selecting scanning lines is changed, an order of reading the display data Vid-b for each row is also changed in accordance with the order of selecting scanning lines. The other structures are substantially the same as in the first embodiment, including simultaneous sampling of data signals into six data lines.

FIG. 16 illustrates the transfer direction and the writing polarity of each row for the first field and the second field.

As illustrated in this drawing, in the second embodiment, in the first field, the positive writing is specified. When a scanning line of an ith row (i is an integer that satisfies $1 \leqq i \leqq 864$) is selected, if i is an odd number (1, 3, 5, . . . , and 863), the rightward transfer is specified, and, if i is an even number (2, 4, 6, . . . , and 864), the leftward transfer is specified. In the second field, the negative writing is specified. When a scanning line of an ith row is selected, if i is an odd number, the leftward transfer is specified, and, if i is an even number, the rightward transfer is specified.

The writing operation occurring when the transfer direction and the writing polarity are specified in this way is obvious, so the description thereof is omitted.

Figure 17B:
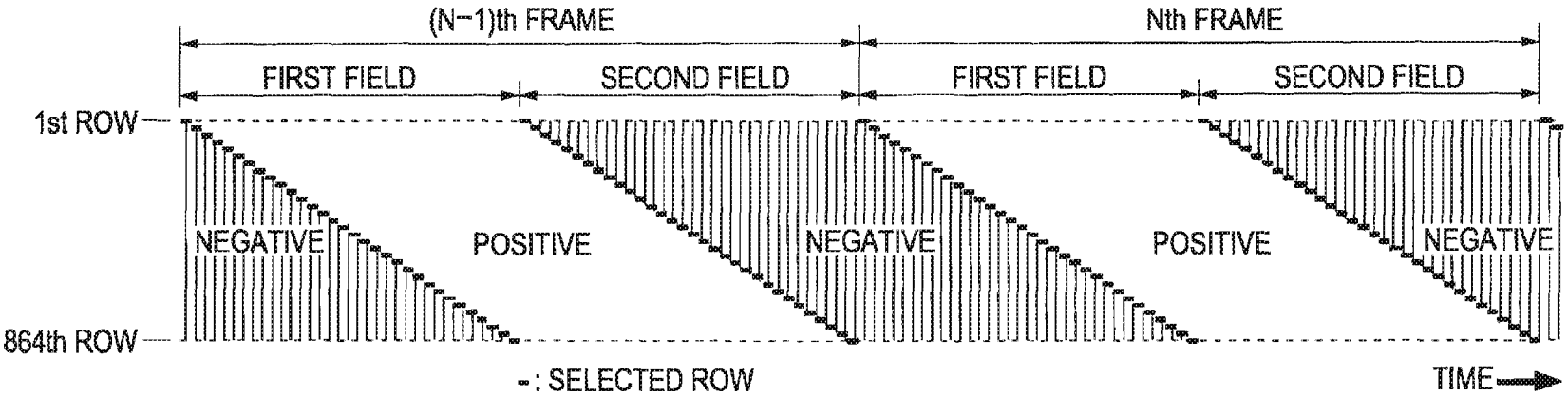

Changes in the writing polarity according to the second embodiment is illustrated in FIG. 17B. Compared with FIG. 17A, which illustrates the first embodiment, the proportion of pixels maintaining positive voltage and that of pixels maintaining negative voltage are different. Therefore, the polarities of the data lines 114 are unbalanced in a maintaining period. As a result, the degrees of leaks of charges written in the pixel electrodes 318 via the TFTs 116 being in the off state are not uniform over all rows. This may cause display evenness to be lost.

In the second embodiment, a voltage corresponding to a gray scale level is written in each of the first field and the second field, and each of the rightward transfer and the leftward transfer is performed once for each row in one frame, as in the first embodiment. Therefore, both display unevenness in which unevenness in display quality caused by the rightward transfer and that by the leftward transfer and another display unevenness resulting from simultaneous sampling of data signals into six data lines can be reduced, as in the first embodiment.

In the first and second embodiments, the number of phase expansion, m, being the number of data lines in which data signals are simultaneously written is six, and the number of image signal lines 171 is six accordingly. However, m may be any number more than one.

In the foregoing description, in a period immediately before sampling of data signals, all the data lines 114 are precharged. The precharge voltage is not limited to a voltage corresponding to black and may be a voltage corresponding to gray or white. Alternatively, precharging may not be performed.

The processing circuit 30 receiving and processing the digital display data Vid-a, as described above, may receive an analog signal and perform phase expansion thereon.

The normally white mode, which displays white when an rms value of voltage of a pixel capacitor is small, may be replaced with the normally black mode, which displays black for small rms value of voltage of a pixel capacitor. Color display may be performed by use of three pixels of red, green, and blue constituting one dot. The display area 100 is not limited to a transmissive type. For example, the display area 100 may be a reflective type and a transflective type, which is intermediate between both.

An application of the invention is not limited to the liquid crystal device described in the embodiments. The invention is applicable to any device as long as display data (a video signal) is phase expanded and sampled into a plurality data lines. For example, the invention is applicable to an device that uses an electroluminescent (EL) element, a field emission (FE) element, an electrophoretic element, and/or a digital mirror element and to a plasma display.

Figure 18:
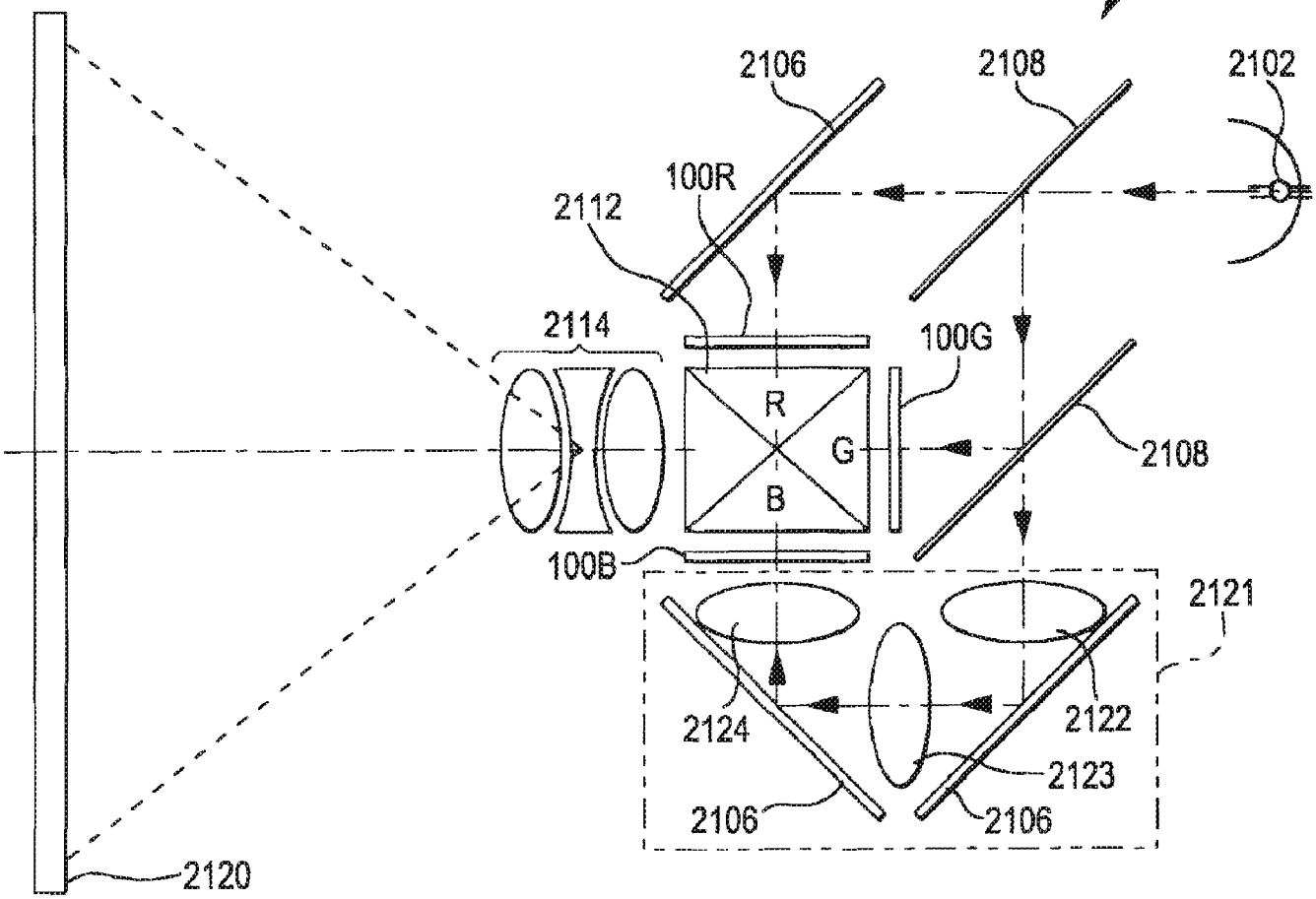
FIG. 18 illustrates a structure of a projector that uses an electro-optical device according to at least one of the embodiments.

Next, an example of an electronic apparatus that uses an electro-optical device according to at least one of the above embodiments will be described below. FIG. 18 is a plan view of a three-panel projector that uses the electro-optical device 1 as a light valve.

As illustrated in this drawing, a lamp unit 2102 including a white light source (e.g., a halogen lamp) is disposed inside a projector 2100. Projected light from the lamp unit 2102 is split into three primary colors of red (R), green (G), and blue (B) by three mirrors 2106 and two dichroic mirrors 2108 disposed in the projector 2100, and the split light components are guided into light valves 100R, 100G, and 100B, which correspond to the primary colors, respectively. Since the optical path for the blue light component is longer than that for each of the red and green light components, the blue light component is guided via a relay lens system 2121 including an entrance lens 2122, a relay lens 2123, and an exit lens 2124 in order to reduce losses.

The light valves 100R, 100G, and 100B have a structure that is substantially the same as that of the display panel 10 according to the embodiments described above and are driven by data signals corresponding to red, green, and blue, respectively. The projector 2100 includes three electro-optical devices 1, each including the display panel 10, corresponding to red, green, and blue.

Light components modulated by the light valves 100R, 100G, and 100B enter a dichroic prism 2112 from three directions, respectively. Through the dichroic prism 2112, the red and blue light components are bent by 90 degrees, whereas the green light component travels in a straight line. As a result, after images of the light components for the colors are combined, a color image is projected on a screen 2120 via a projection lens 2114.

Since the light components corresponding to the primary colors R, G, and B enter the light valves 100R, 100G, and 100B by means of the dichroic mirrors 2108, respectively, a color filter is not required. A transmitted image through each of the light valves 100R and 100B is projected after being reflected from the dichroic prism 2112, whereas a transmitted image through the light valve 100G is projected without being reflected. Therefore, it is necessary to cause the transmitted image through the light valve 100G to be made to be an image in which the left and right of the transmitted image through each of the light valves 100R and 100B are inverted.

An electro-optical device according to at least one of the embodiments can be used in various electronic apparatuses. Examples of the electronic apparatuses include, in addition to a projection type described with reference to FIG. 18, a direct-view type, such as a television, a viewfinder videotape recorder, a car navigation system, a pager, an electronic organizer, a personal digital assistant, a calculator, a word processor, a workstation, a videophone, a POS terminal, a digital still camera, a mobile phone, and a device including a touch panel.

What is claimed is:

1. An electro-optical device comprising:

a plurality of scanning lines arranged in respective rows;

a plurality of data lines arranged in respective columns, and grouped in blocks for every m columns (m being an integer greater than one);

a plurality of pixels, each pixel capable of performing a gray scale level in accordance with a data signal sampled from a corresponding data line of the plurality of data lines when a corresponding scanning line of the plurality of scanning lines is selected by an applied predetermined selection voltage;

a scanning-line driving circuit that selects the plurality of scanning lines one by one in a predetermined order in each of a first field and a second field of a frame while skipping a predetermined number of rows of scanning lines and applies the selection voltage to the selected scanning line;

a block selecting circuit that selects the blocks one by one in either a right direction or a left direction during the period that the scanning line is selected by the scanning-line driving circuit;

a sampling circuit that samples a data signal corresponding to a gray scale level into each of the m columns of a block of data lines selected by the block selecting circuit; and a control circuit that controls the block selecting circuit to select the blocks one by one in one of the right direction and the left direction when one scanning line is selected in the first field, to select the blocks one by one in the other of the right direction and the left direction when the same scanning line is selected in the second field and to select the blocks one by one in opposite directions between adjacent scanning lines of the plurality of scanning lines; and a display area in which the plurality of pixels are placed, the display area being divided into at least a first region and a second region in a direction of the columns, wherein the scanning-line driving circuit alternately selecting scanning lines belonging to the first region and scanning lines belonging to the second region one by one during each of the first field and the second field such that the scanning lines are selected one by one in each of the first region and the second region upwardly or downwardly, during the first field, when a scanning line belonging to the first region is selected, the data signal has a voltage being one of two levels, either a higher level or a lower level than a predetermined reference voltage and, when a scanning line belonging to the second region is selected, the data signal has a voltage being the other of the higher level or the lower level than the reference voltage, and during the second field, when a scanning line in the first region is selected, the data signal has a voltage being the other of the higher level and the lower level than the reference voltage and, when a scanning line in the second region is selected, the data signal having a voltage being the one of the higher level and the lower level than a reference voltage, and wherein the block selecting circuit repeating an operation of selecting the blocks one by one in the right direction when a first scanning line of the plurality of scanning lines is selected, in the left direction when a second scanning line following the first scanning line is selected, in the left direction when a third scanning line following the second scanning line is selected, and in the right direction when a fourth scanning line following the third scanning line is selected, and wherein during the first field, when a scanning line is an odd numbered scanning line, a first direction of transfer is specified for scanning lines flowing into the second region and a second direction of transfer is specified for the scanning lines belonging to the first region and when a scanning line is an even numbered scanning line, the second direction transfer is specified for scanning lines belonging to the second region and the first direction of transfer is specified for scanning lines belonging to the first region, and during the second field, when a scanning line is an odd numbered scanning line, the second direction of transfer is specified for scanning lines belonging to the second region and the first direction of transfer is specified for scanning lines belonging to the first region and when a scanning line is an even numbered scanning line, the first direction of transfer is specified for scanning lines belonging to the second region and the second direction of transfer is specified for scanning lines belonging to the first region, the first direction being one of a rightward direction and a leftward direction and the second direction being the other of the rightward direction and the leftward direction.

2. The electro-optical device according to claim 1, the scanning-line driving circuit selecting the plurality of scanning lines one by one upwardly or downwardly in each of the first field and the second field, in the first field, the data signal having a voltage being one of two levels, either a higher level or a lower level than a predetermined reference voltage, and in the second field, the data signal having a voltage being the other of the higher level or the lower level than a reference voltage.

3. The electro-optical device according to claim 2, the block selecting circuit repeating an operation of selecting the blocks one by one in the right direction when a first scanning line is selected, and in the left direction when a second scanning line following the first scanning line is selected.

4. A method for driving an electro-optical device including a plurality of scanning lines arranged in respective rows, a plurality of data lines arranged in respective columns and grouped in blocks for every m columns (m being an integer greater than one), and a plurality of pixels, each pixel capable of performing a gray scale level in accordance with a data signal sampled from a corresponding data line of the plurality of data lines when a corresponding scanning line of the plurality of scanning lines is selected by an applied predetermined selection voltage, the method comprising:

selecting the plurality of scanning lines one by one in a predetermined order in each of a first field and a second field of a frame while skipping a predetermined number of rows of scanning lines and applying the selection voltage to the selected scanning line;

selecting the blocks one by one in either a right direction or a left direction during a period in which the scanning line is selected;

sampling a data signal corresponding to a gray scale level into each of the m columns of data lines of the selected block;

performing control such that the blocks are selected one by one in one of the right direction and the left direction when one scanning line is selected in the first field, the blocks are selected one by one in the other of the right direction and the left direction when the same scanning line is selected in the second field, and the blocks are selected one by one in opposite directions between adjacent scanning lines of the plurality of scanning; lines;

repeating an operation of selecting the blocks one by one in the right direction when a first scanning line of the plurality of scanning lines is selected, in the left direction when a second scanning line following the first scanning line is selected, in the left direction when a third scanning line following the second scanning line is selected, and in the right direction when a fourth scanning line following the third scanning line is selected;

dividing a display area in which the plurality of pixels are placed into at least a first region and a second region in a direction of the columns;

alternately selecting the scanning-line driving circuit scanning lines belonging to the first region and scanning lines belonging to the second region one by one during each of the first field and the second field such that the scanning lines are selected one by one in each of the first region and the second region upwardly or downwardly, wherein during the first field, when a scanning line belonging to the first region is selected, the data signal has a voltage being one of two levels, either a higher level or a lower level than a predetermined reference voltage and, when a scanning line belonging to the second region is selected, the data signal has a voltage being the other of the higher level or the lower level than the reference voltage, and wherein during the second field, when a scanning line in the first region is selected, the data signal has a voltage being the other of the higher level and the lower level than the reference voltage and, when a scanning line in the second region is selected, the data signal, having a voltage being the one of the higher level and the lower level than a reference voltage;

specifying, during the first field, when a scanning line is an odd numbered scanning line, a first direction of transfer for scanning lines flowing into the second region and a second direction of transfer for the scanning lines belonging to the first region and specifying, when a scanning line is an even numbered scanning line, the second direction transfer for scanning lines belonging to the second region and the first direction of transfer for scanning lines belonging to the first region; and specifying, during the second field, when a scanning line is an odd numbered scanning line, the second direction of transfer for scanning lines belonging to the second region and the first direction of transfer for scanning lines belonging to the first region and specifying, when a scanning line is an even numbered scanning line, the first direction of transfer for scanning lines belonging to the second region and the second direction of transfer for scanning lines belonging to the first region, the first direction being one of a rightward direction and a leftward direction and the second direction being the other of the rightward direction and the leftward direction.

5. An electronic apparatus comprising the electro-optical device according to claim 1.

6. An electro-optical device comprising:

a plurality of scanning lines arranged in respective rows;

a plurality of data lines arranged in respective columns, and grouped in blocks for every m columns (m being an integer greater than one);

a plurality of pixels, each having a connection to a scanning line and a connection to a data line, the scanning line controlling access to the data line, and each pixel operating according to a data signal received from the data line;

a frame having a plurality of fields;

a scanning-line driving circuit that selects the plurality of scanning lines one by one according to a predetermined order of the scanning lines according to the plurality of fields of the frame while skipping a predetermined number of rows of scanning lines;

a data-line signal providing circuit that provides the data signal to the data lines block by block in a predetermined direction; and a control circuit that provides controlling signals to the scanning-line driving circuit and the data-line signal providing circuit to coordinate all the components to operate in a predetermined fashion, the control circuit controlling the block selecting circuit to select the blocks one by one in opposite directions between adjacent scanning lines of the plurality of scanning lines; and a display area in which the plurality of pixels are placed, the display area being divided into at least a first region and a second region in a direction of the columns, wherein the scanning-line driving circuit alternately selecting scanning lines belonging to the first region and scanning lines belonging to the second region one by one during each of the first field and the second field such that the scanning lines are selected one by one in each of the first region and the second region upwardly or downwardly, during the first field, when a scanning line belonging to the first region is selected, the data signal has a voltage being one of two levels, either a higher level or a lower level than a predetermined reference voltage and, when a scanning line belonging to the second region is selected, the data signal has a voltage being the other of the higher level or the lower level than the reference voltage, and during the second field, when a scanning line in the first region is selected, the data signal has a voltage being the other of the higher level and the lower level than the reference voltage and, when a scanning line in the second region is selected, the data signal having a voltage being the one of the higher level and the lower level than a reference voltage, and wherein the block selecting circuit repeating an operation of selecting the blocks one by one in the right direction when a first scanning line of the plurality of scanning lines is selected, in the left direction when a second scanning line following the first scanning line is selected, in the left direction when a third scanning line following the second scanning line is selected, and in the right direction when a fourth scanning line following the third scanning line is selected, and wherein during the first field, when a scanning line is an odd numbered scanning line, a first direction of transfer is specified for scanning lines flowing into the second region and a second direction of transfer is specified for the scanning lines belonging to the first region and when a scanning line is an even numbered scanning line, the second direction transfer is specified for scanning lines belonging to the second region and the first direction of transfer is specified for scanning lines belonging to the first region, and during the second field, when a scanning line is an odd numbered scanning line, the second direction of transfer is specified for scanning lines belonging to the second region and the first direction of transfer is specified for scanning lines belonging to the first region and when a scanning line is an even numbered scanning line, the first direction of transfer is specified for scanning lines belonging to the second region and the second direction of transfer is specified for scanning lines belonging to the first region, the first direction being one of a rightward direction and a leftward direction and the second direction being the other of the rightward direction and the leftward direction.

7. The electro-optical device according to claim 6, the data-line signal providing circuit including a block selecting circuit and a sampling circuit, the block selecting circuit selecting the blocks of data lines one by one according to the predetermined order so as to access the sampling circuit.

8. The electro-optical device according to claim 7, the sampling circuit providing data signals to the data lines that have been selected by the block selecting circuit.

9. The electro-optical device according to claim 6, each pixel of the plurality of pixels emitting light according to the data signal received from the data line.

10. The electro-optical device according to claim 6, the predetermined fashion being based on the predetermined order of the scanning lines and the predetermined direction of the data lines.

* * * * *